United States Patent [19]

Robinson

[11] 3,967,419

[45] July 6, 1976

[54] GUTTERING SYSTEMS

[75] Inventor: Brian Robinson, Caerphilly, England

[73] Assignee: Catnic Components Ltd., Caerphilly, United Kingdom

[22] Filed: Dec. 14, 1973

[21] Appl. No.: 424,641

[30] Foreign Application Priority Data

Dec. 22, 1972 United Kingdom ..... 59377/72

[52] U.S. Cl. ..... 52/16; 52/95

[51] Int. Cl.[2] ..... E04D 13/04

[58] Field of Search ..... 52/94, 95, 96, 16, 11

[56] References Cited

UNITED STATES PATENTS

| | | | |
|---|---|---|---|
| 334,160 | 1/1886 | Berger | 52/16 |
| 929,684 | 8/1909 | Mills et al. | 52/11 |
| 1,005,885 | 10/1911 | Ross et al. | 52/11 |
| 1,142,253 | 6/1915 | Harris | 52/96 |
| 1,526,825 | 2/1925 | Bohnsack | 52/16 |
| 3,173,268 | 3/1965 | Sunshine | 52/11 X |
| 3,188,772 | 6/1965 | Tennison | 52/11 |
| 3,300,911 | 1/1967 | Riddell | 52/16 |
| 3,344,563 | 10/1967 | Miles et al. | 52/94 X |
| 3,507,078 | 4/1970 | Sayers | 52/95 X |

*Primary Examiner*—Price C. Faw, Jr.

*Attorney, Agent, or Firm*—Woodhams, Blanchard and Flynn

[57] ABSTRACT

The invention relates to members for forming in use a complete guttering system which can be used for any slope of roof. There are two members, one a gutter-fascia member and the other a soffit member, and each member has a complementary part of a hinge or pivot so that when the two hinge or pivot parts are connected, a hinge or pivot is formed which allows relative rotation of the two members so that any roof pitch can be accommodated.

21 Claims, 81 Drawing Figures

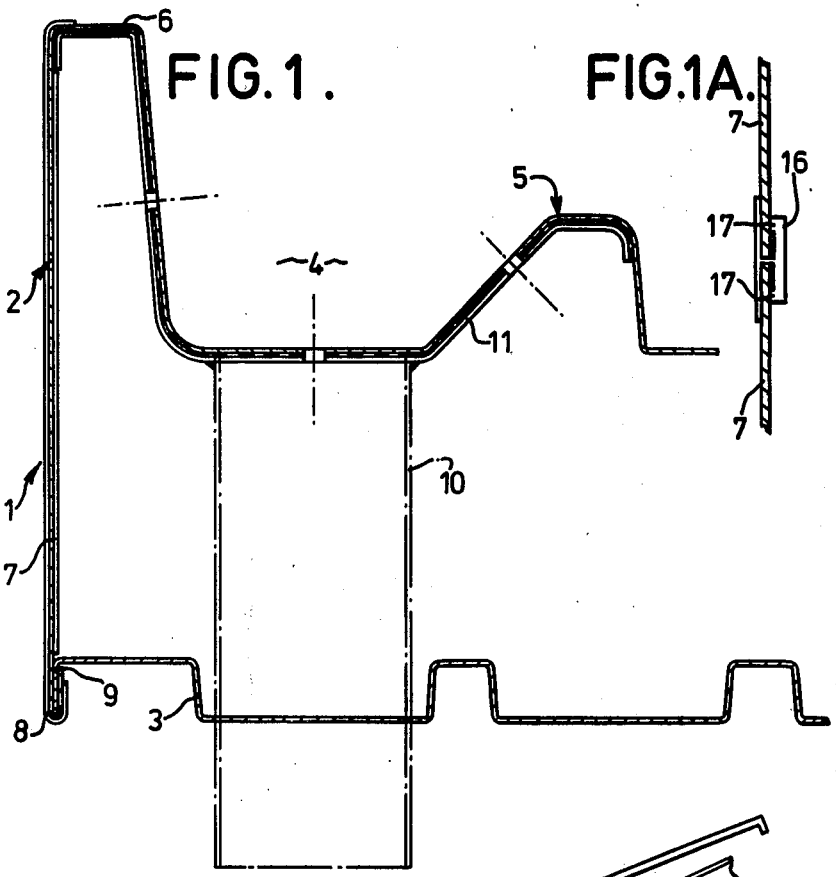
FIG. 1.
FIG. 1A.
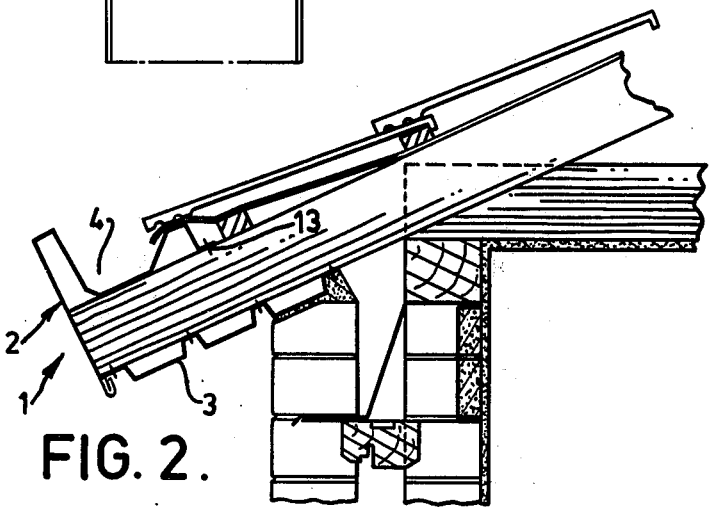
FIG. 2.

FIG. 3.
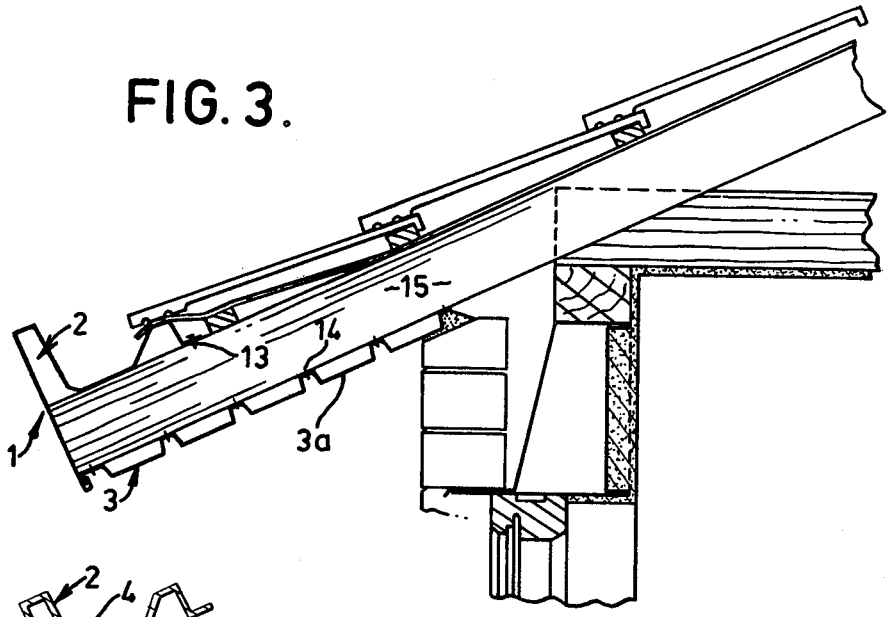
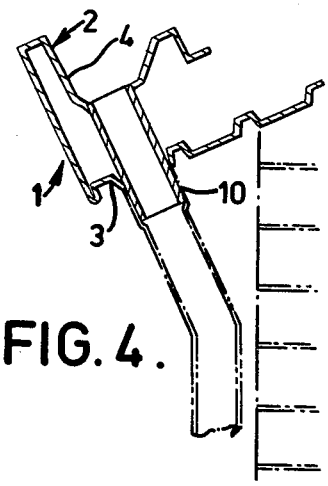
FIG. 4.
FIG. 5.
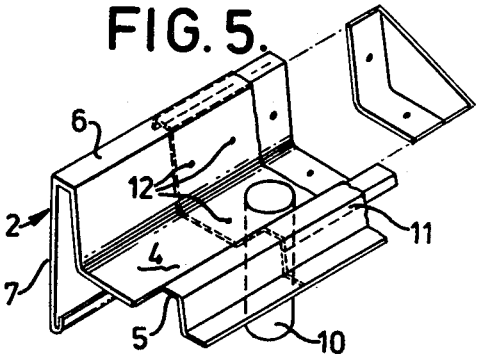
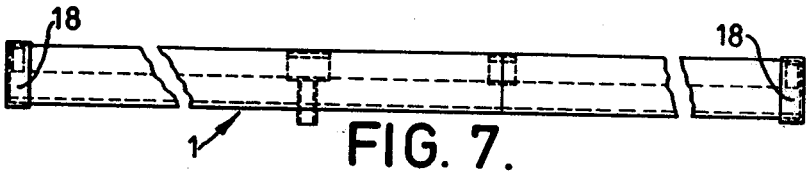
FIG. 7.

FIG. 6.
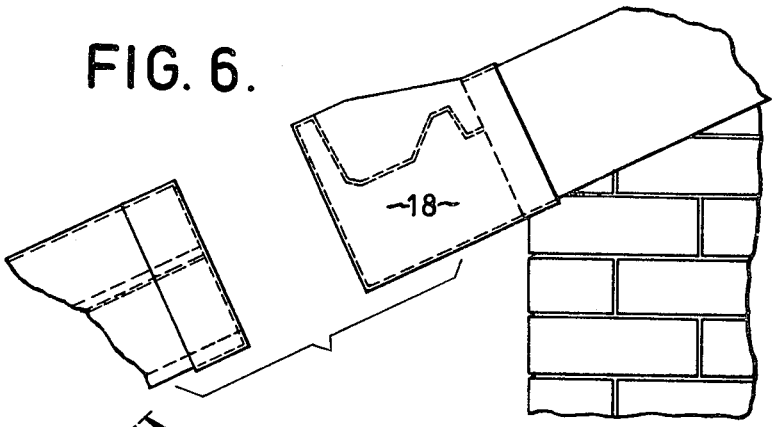
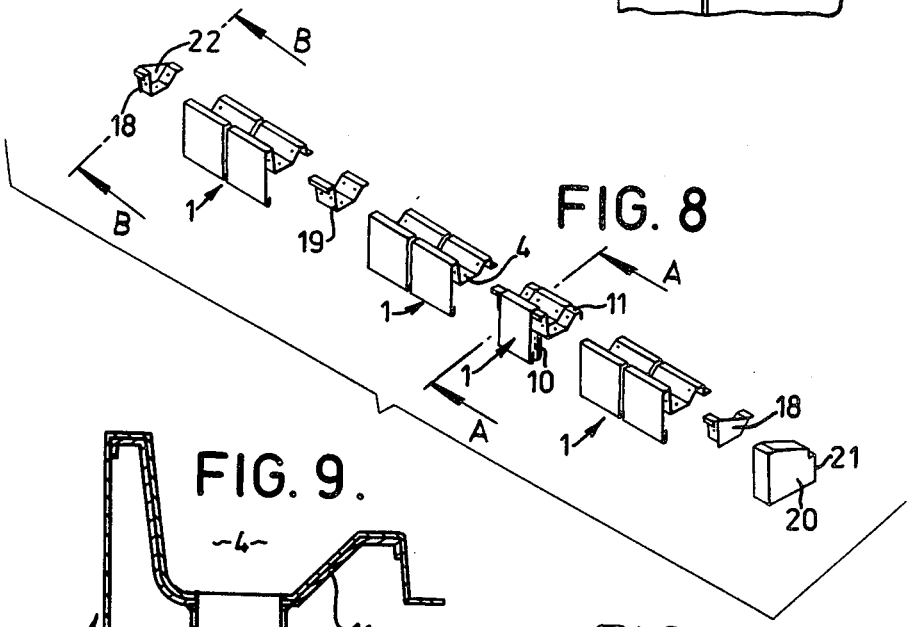
FIG. 8
FIG. 9.
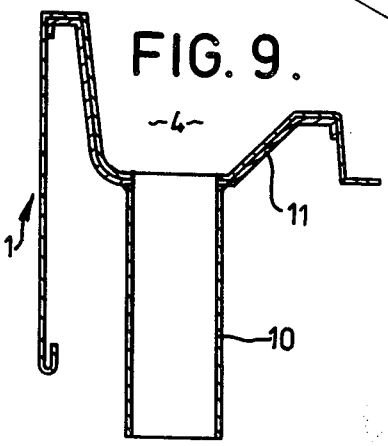
FIG. 10.
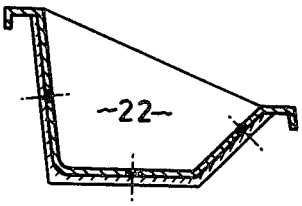

FIG. 13.
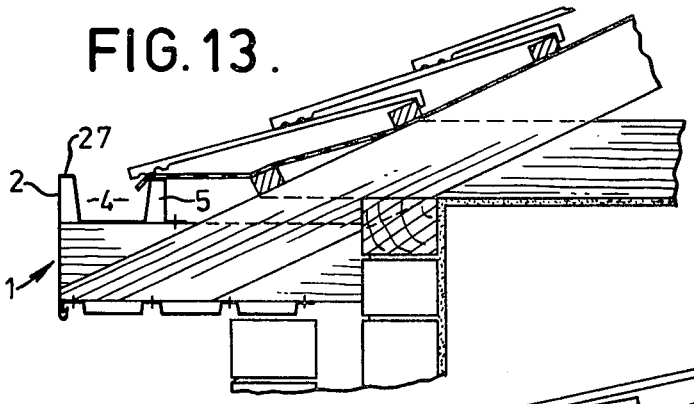
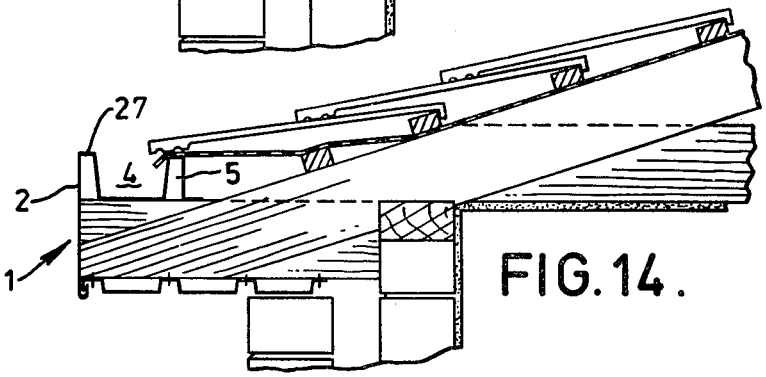
FIG. 14.
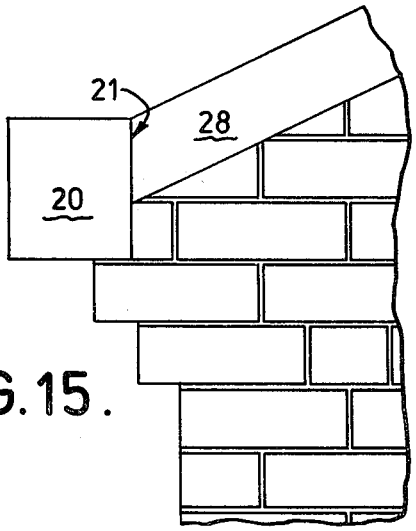
FIG. 15.

FIG.16.
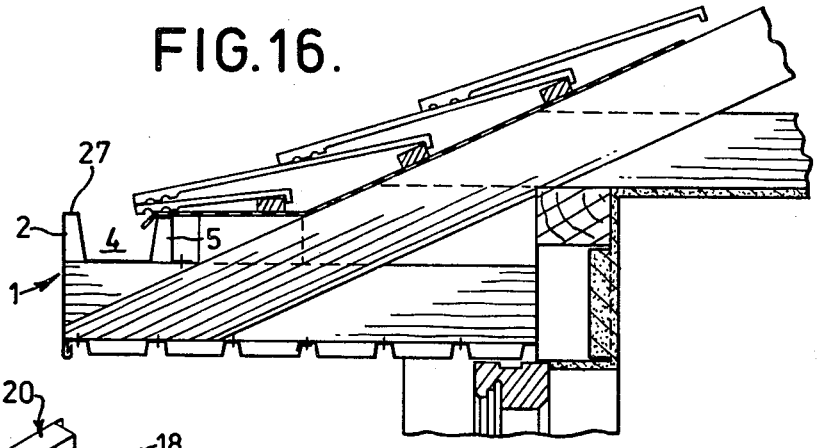
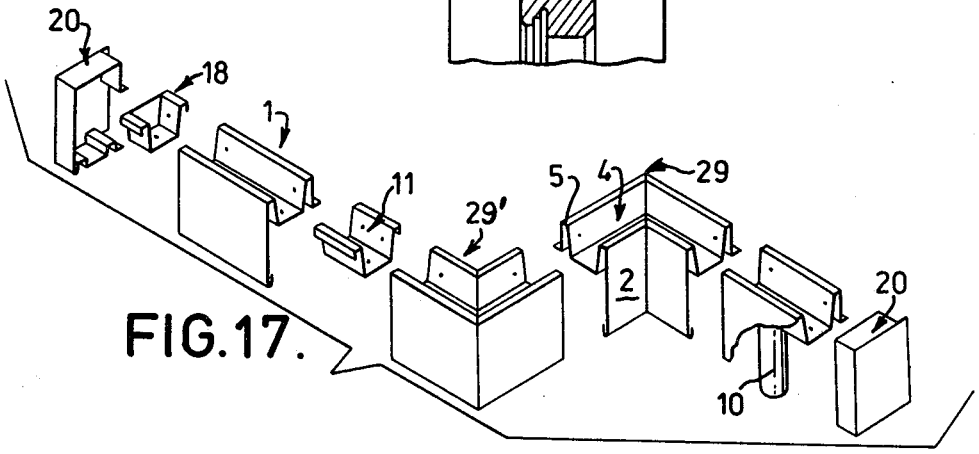
FIG.17.
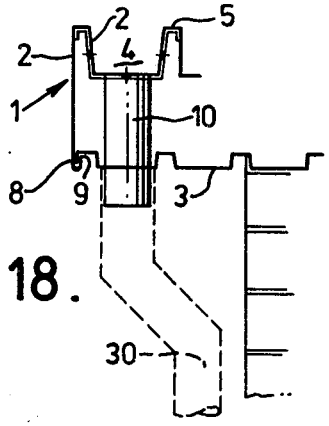
FIG.18.

FIG. 26 J.
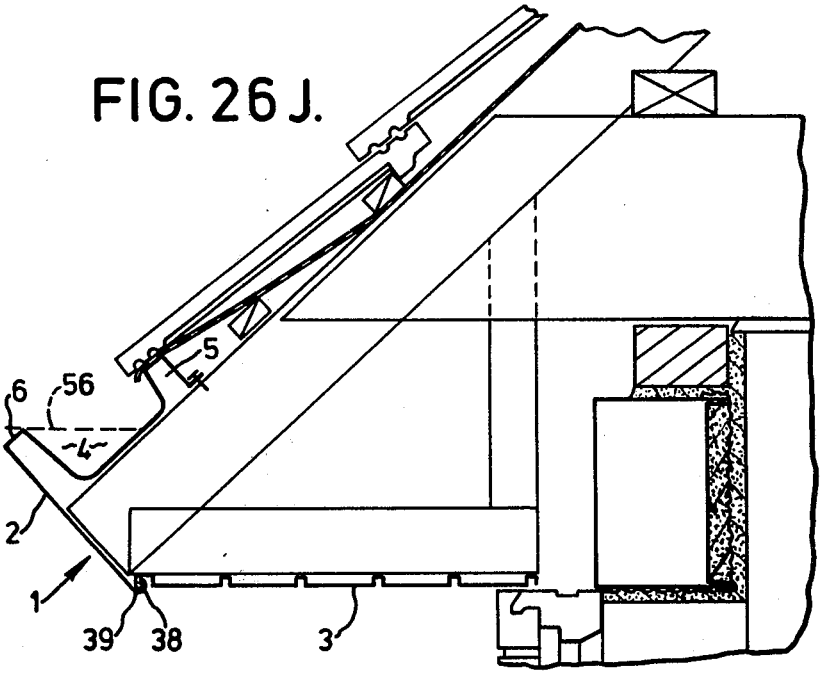
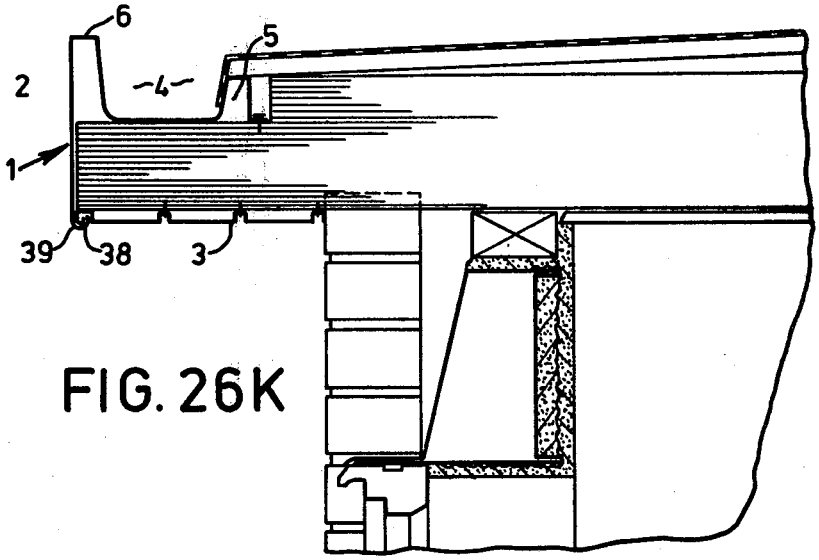
FIG. 26K

FIG. 27A
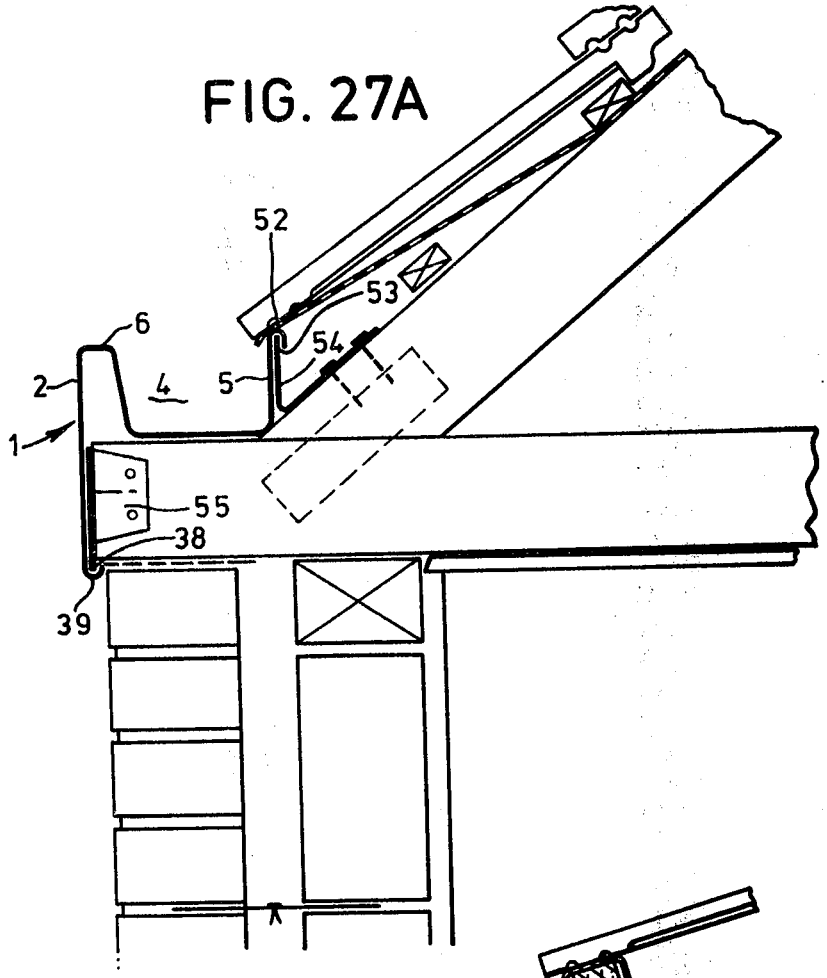
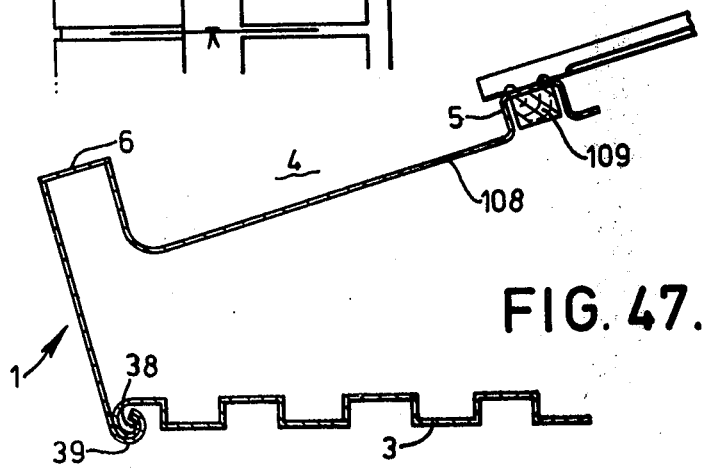
FIG. 47.

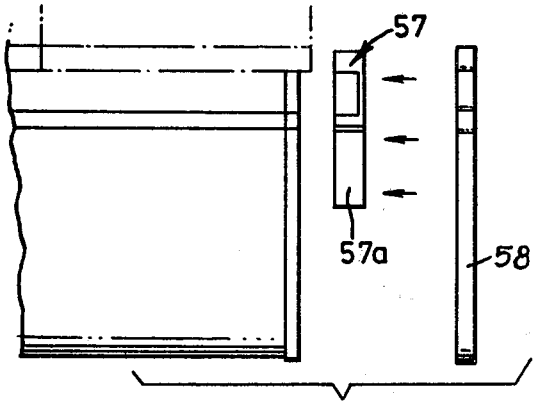
FIG. 28A.
FIG. 28.
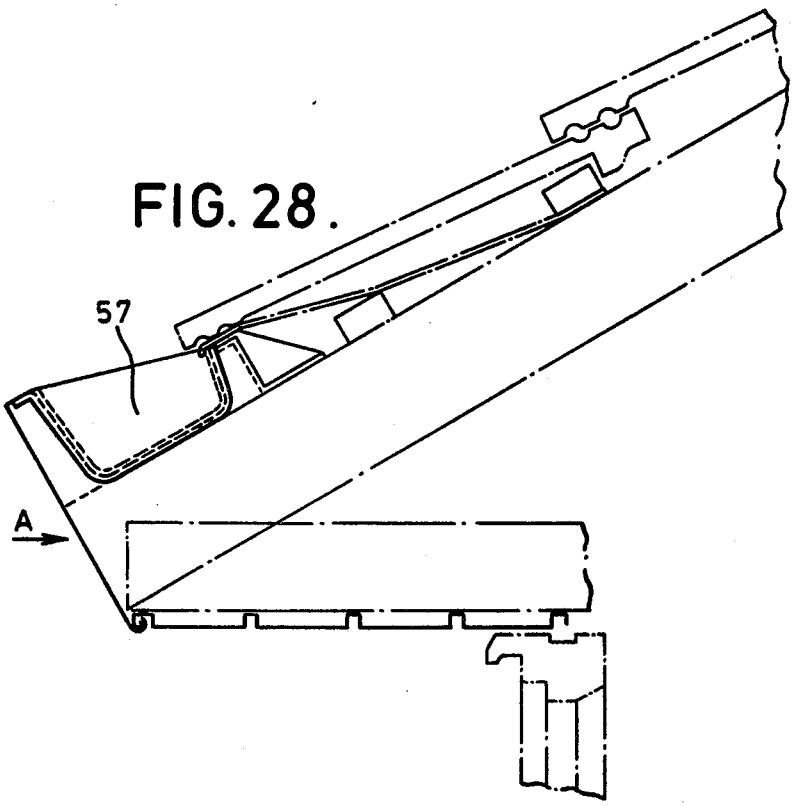

FIG. 30.
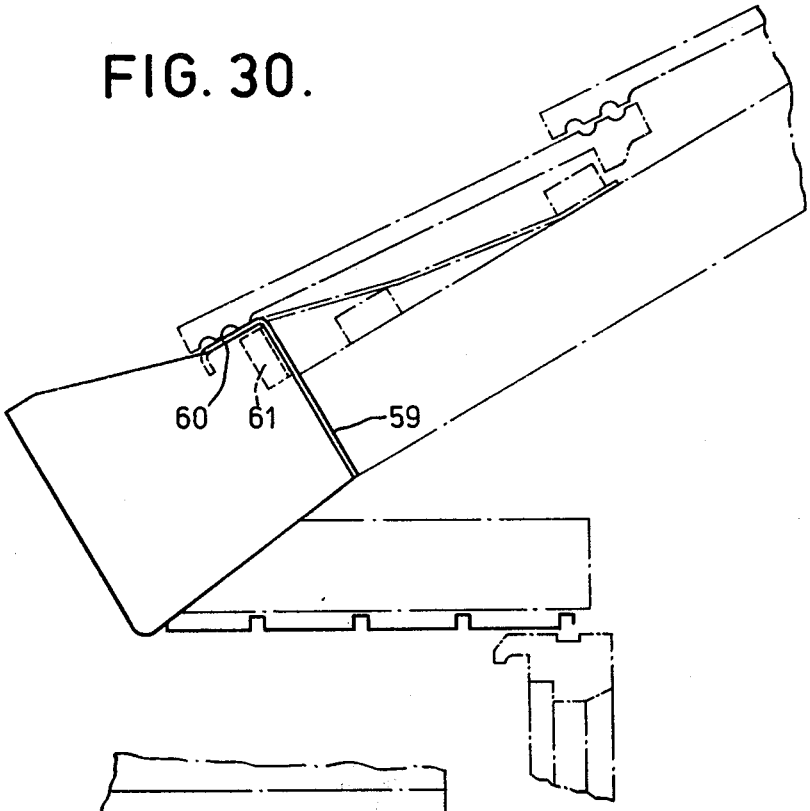
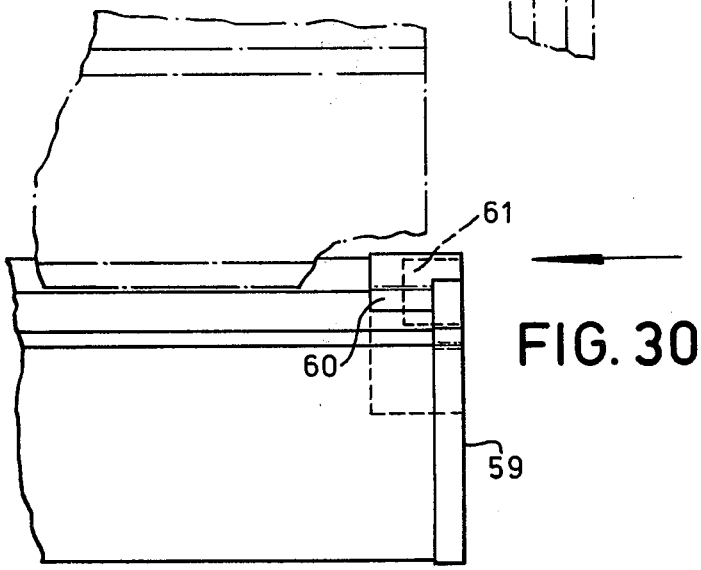
FIG. 30A.

FIG. 32.
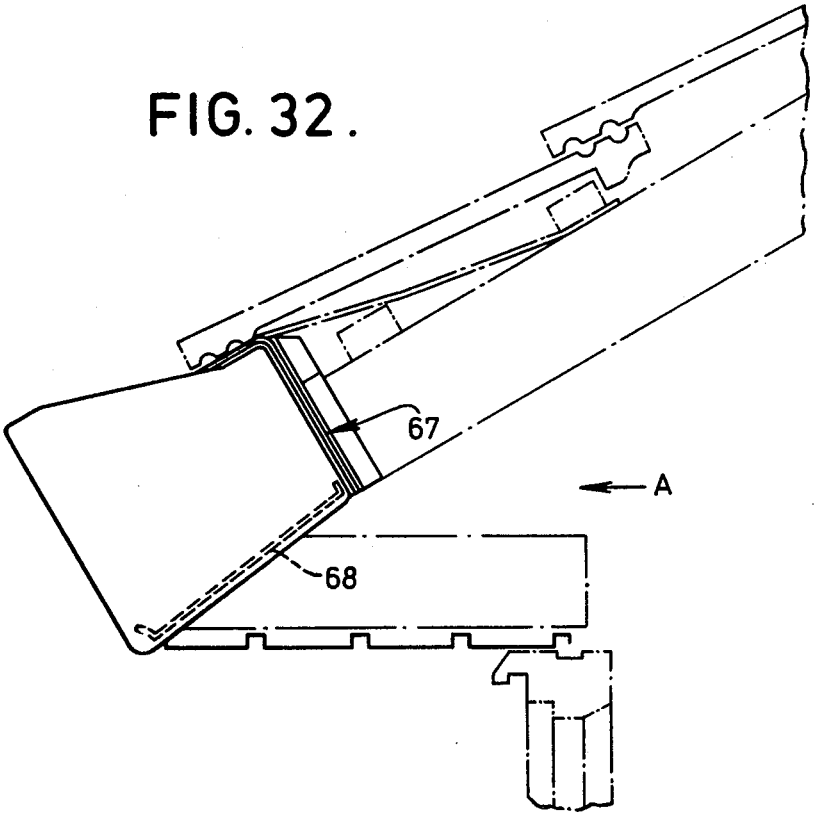
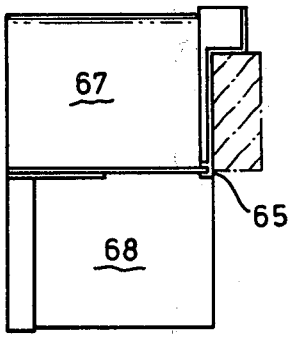
FIG. 32A.

FIG. 43A.
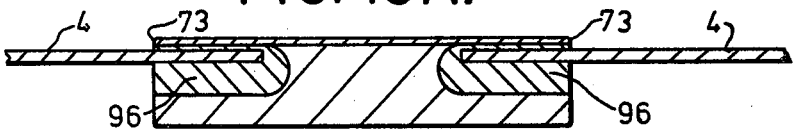
FIG. 44A.
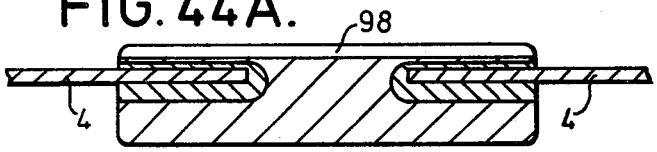
FIG. 44.
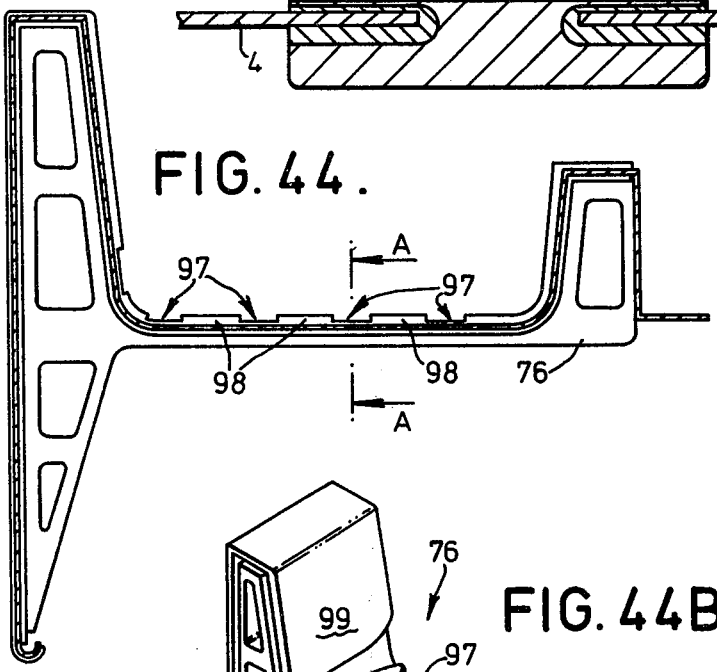
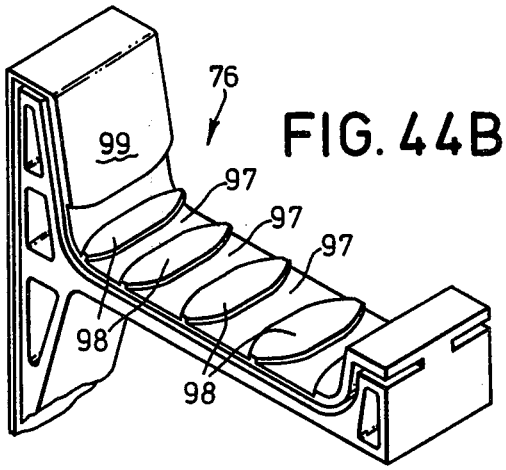
FIG. 44B.

57
A
102
A
104
105

58
106
4
107
1
A
58
A 57
100
103
102
4

101

GUTTERING SYSTEMS

The invention relates to building members, and particularly to members for forming gutter units.

Guttering is necessary to carry away rain water flowing on a roof and in the past has had to be fitted separately to a building during construction. The gutters also require maintenance periodically, and can be unsightly.

It is an object of the invention to overcome these disadvantages.

According to one aspect of the invention there is provided members for producing a gutter-fascia-soffit unit for the roof of a building, comprising a pre-formed first member including hinge or pivot means and a pre-formed second member including hinge or pivot means complementary to the first means.

Thus a guttering unit, using individual members, can be applied to and can accommodate a range of roof pitches. A tilting member takes the place of the usual tilting fillet and in use is capable of supporting a roof. The tilting member is suitably on a side of the gutter opposite the fascia and affords the advantage that the element is one unit, which can reduce manufacturing costs and on site building costs.

According to a second aspect, there is provided a barge board member of substantially J-shape which on one side forms a channel member adapted to be supported by the roof members a building, one side of the channel extending beyond the web of the channel and comprising a nose or lip on a side of the barge board remote from the limbs of the channel member.

According to a third aspect, there is provided a roof gutter unit when assembled from members as hereinbefore defined.

The soffit board may be corrugated, profiled so that it comprises a series of longitudinally extending corrugations, or planar.

Embodiment of the invention are diagrammatically illustrated, by way of example, in the accompanying drawings, in which:

FIG. 1 shows an end elevation of a gutter member and soffit member;

FIG. 1A shows a detail of a joint;

FIG. 2 shows an elevation of the gutter and soffit in place at the roof of a house;

FIG. 3 shows an elevation of the gutter and soffit on a large eave;

FIG. 4 shows an elevation of a drain pipe member;

FIG. 5 shows a perspective view of part of the gutter;

FIG. 6 shows a detail at a gutter end;

FIG. 7 shows a front elevation;

FIG. 8 shows an exploded perspective view of the gutter assembly;

FIG. 9 shows a section on the line A—A of FIG. 8;

FIG. 10 shows a section on the line B—B of FIG. 8;

FIGS. 12 to 14 show respectively vertical sections at the eaves of roofs of 45°, 25°, 17½° pitch;

FIG. 15 shows an end elevation;

FIG. 16 shows a 25° pitch roof with a larger overhang;

FIG. 17 shows a perspective view of an internal and external corner;

FIG. 18 shows a rain water outlet;

FIG. 27A shows a level fixing to a pitched roof;

FIG. 28 shows an end elevation of a stop end seal mounted on the unit and FIG. 28A shows a view in the direction of the arrow "A" in FIG. 28;

FIGS. 30 and 30A show respective end and side elevations of an end stop rear cover in position in the unit;

FIGS. 32 and 32A show bottom and rear covers mounted on the unit, FIG. 32A being a view in the direction of the arrow "A" of FIG. 32;

Figure 34:
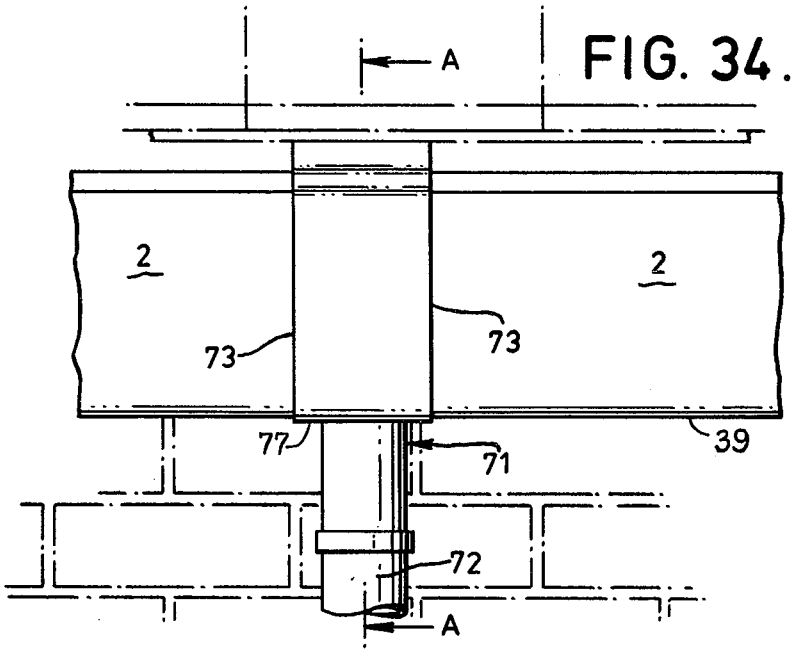
Figure 34A:
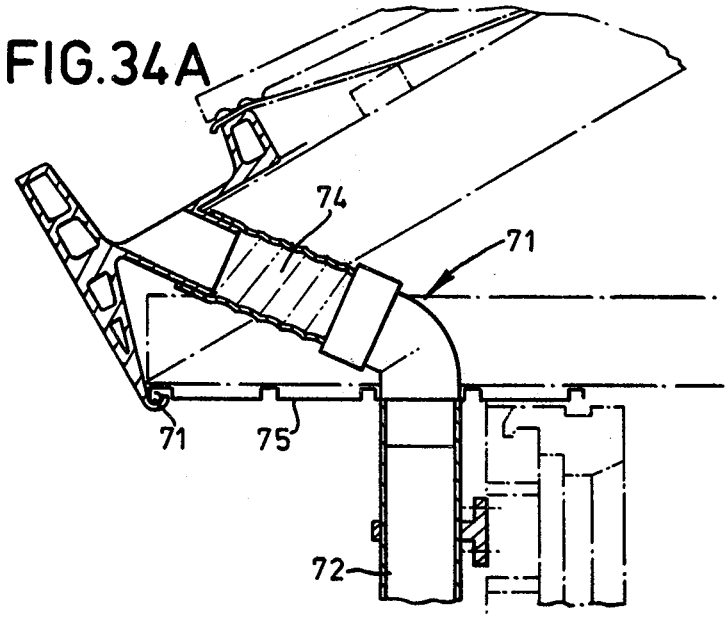
Figure 35:
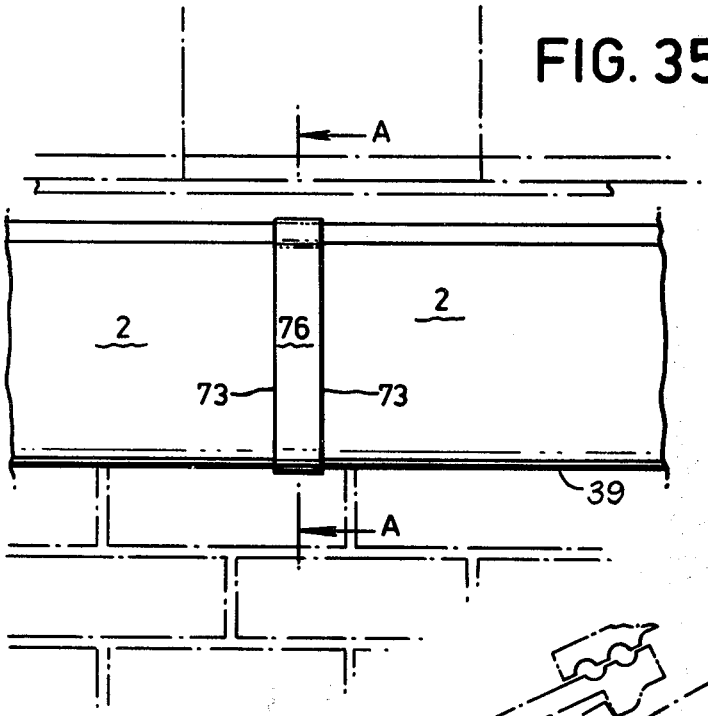
Figure 35A:
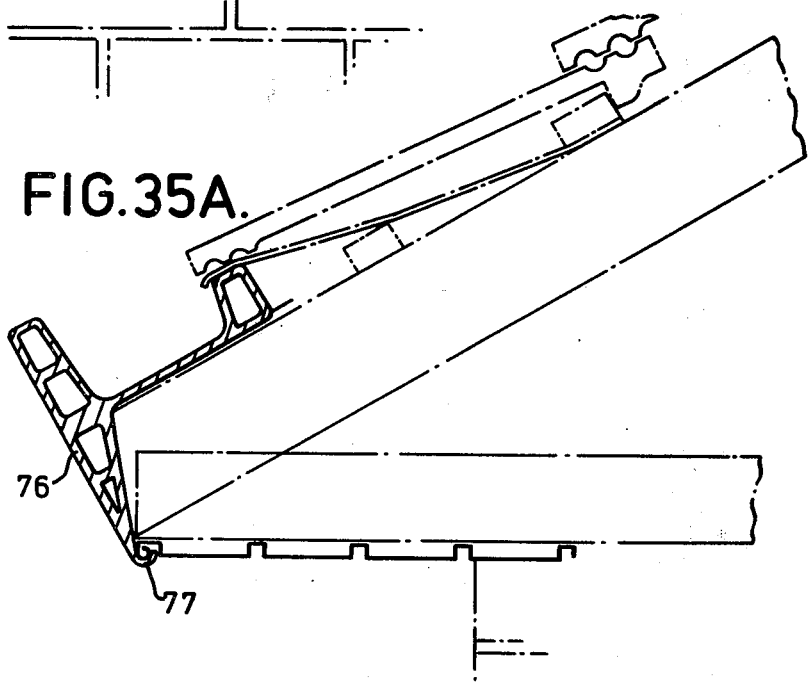
Figure 36:
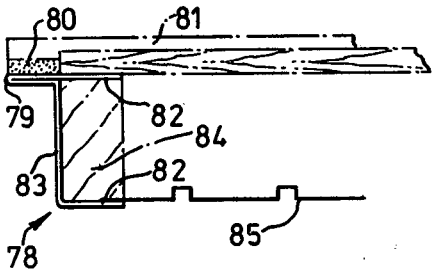
Figure 36A:
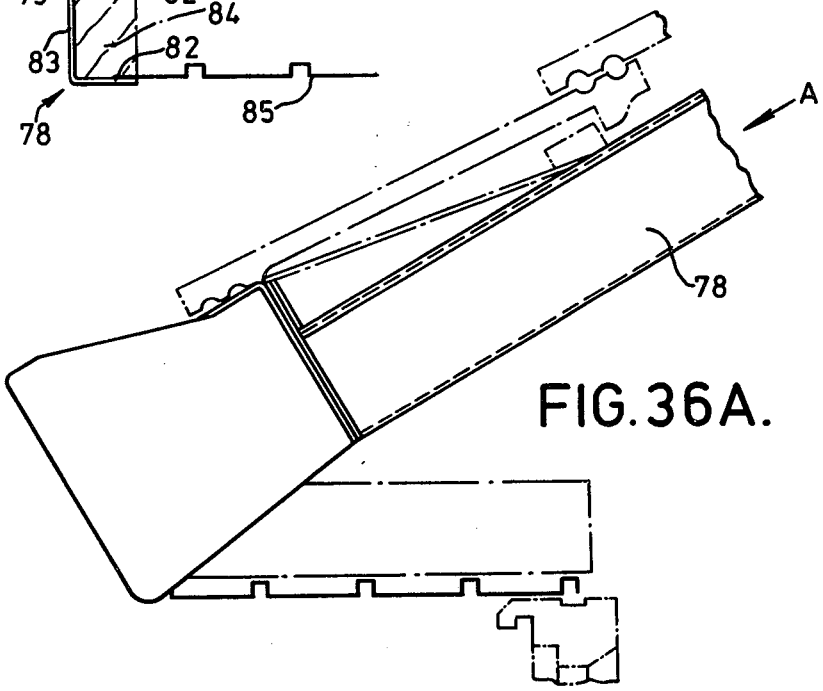
Figure 36B:
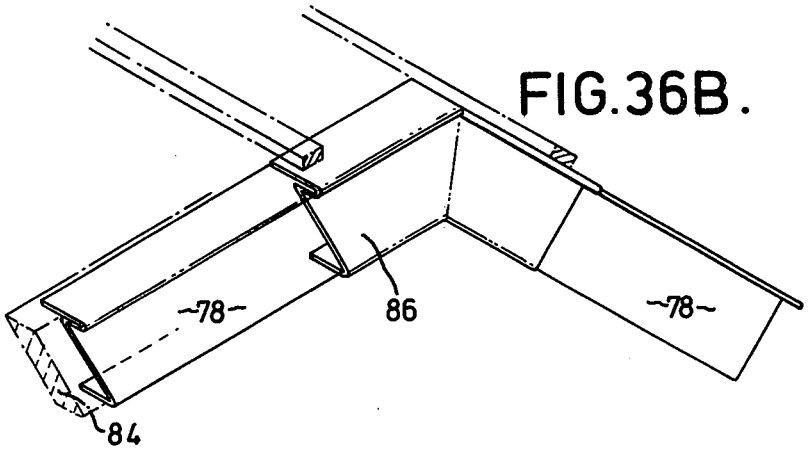
Figure 37:
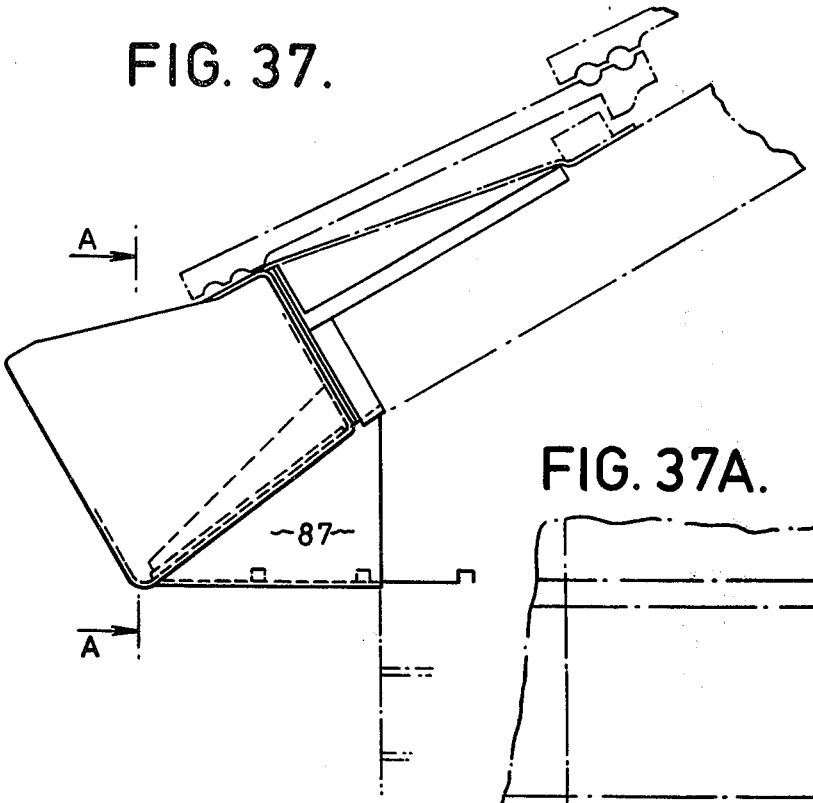
Figure 37A:
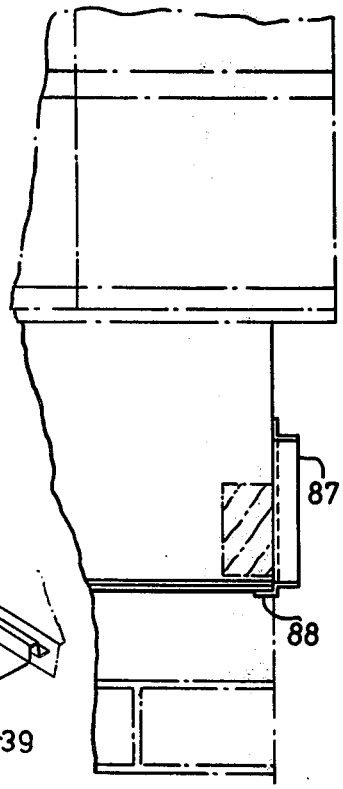
Figure 38:
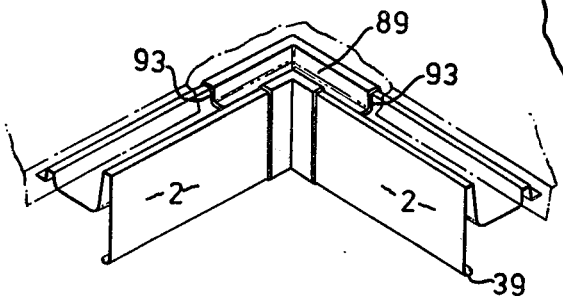
Figure 39:
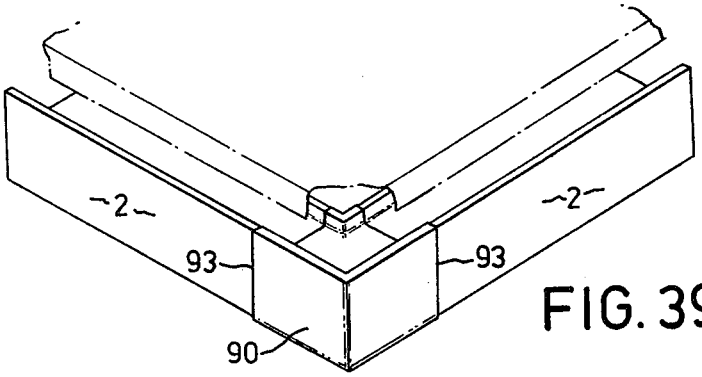
Figure 40:
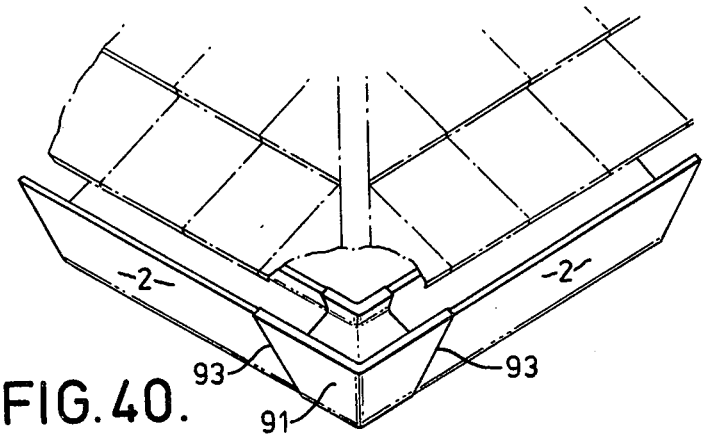
Figure 41:
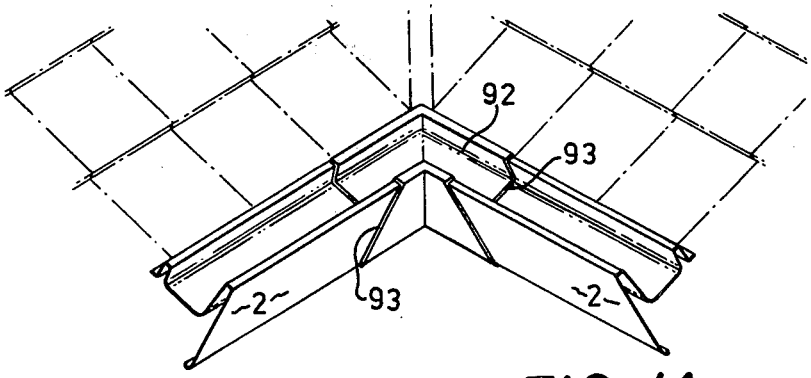
Figure 42:
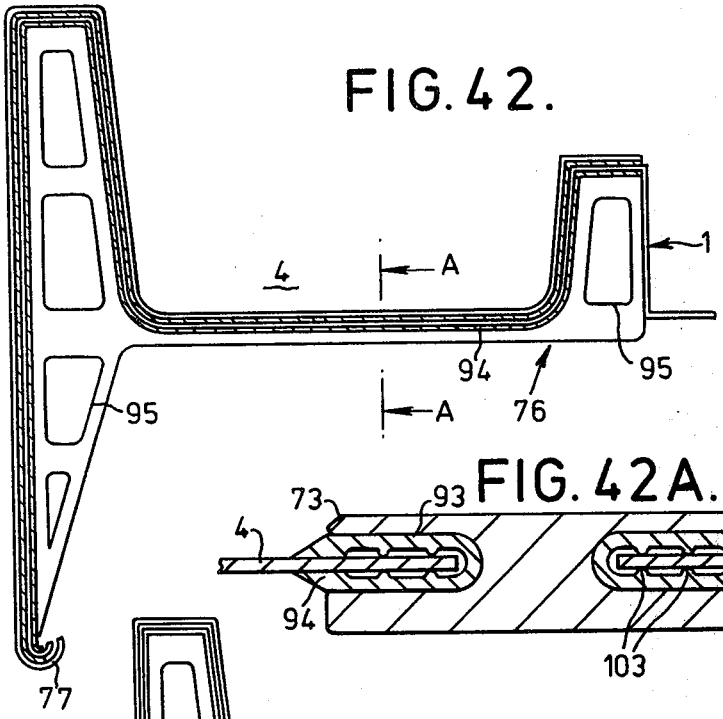
Figure 42A:
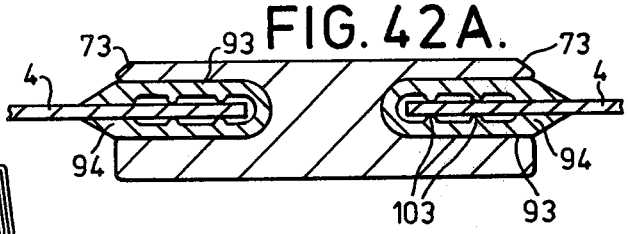
Figure 43:
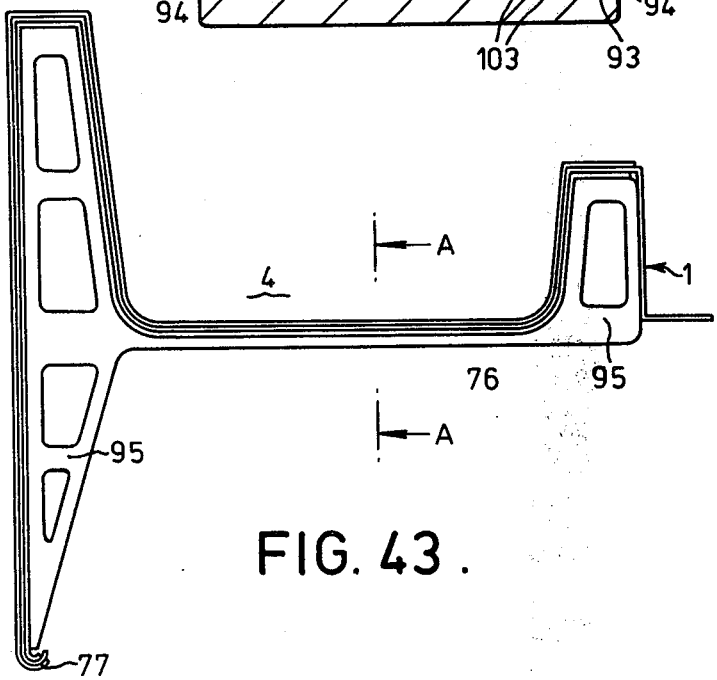
Figures 45, 45A, 46, 46A:
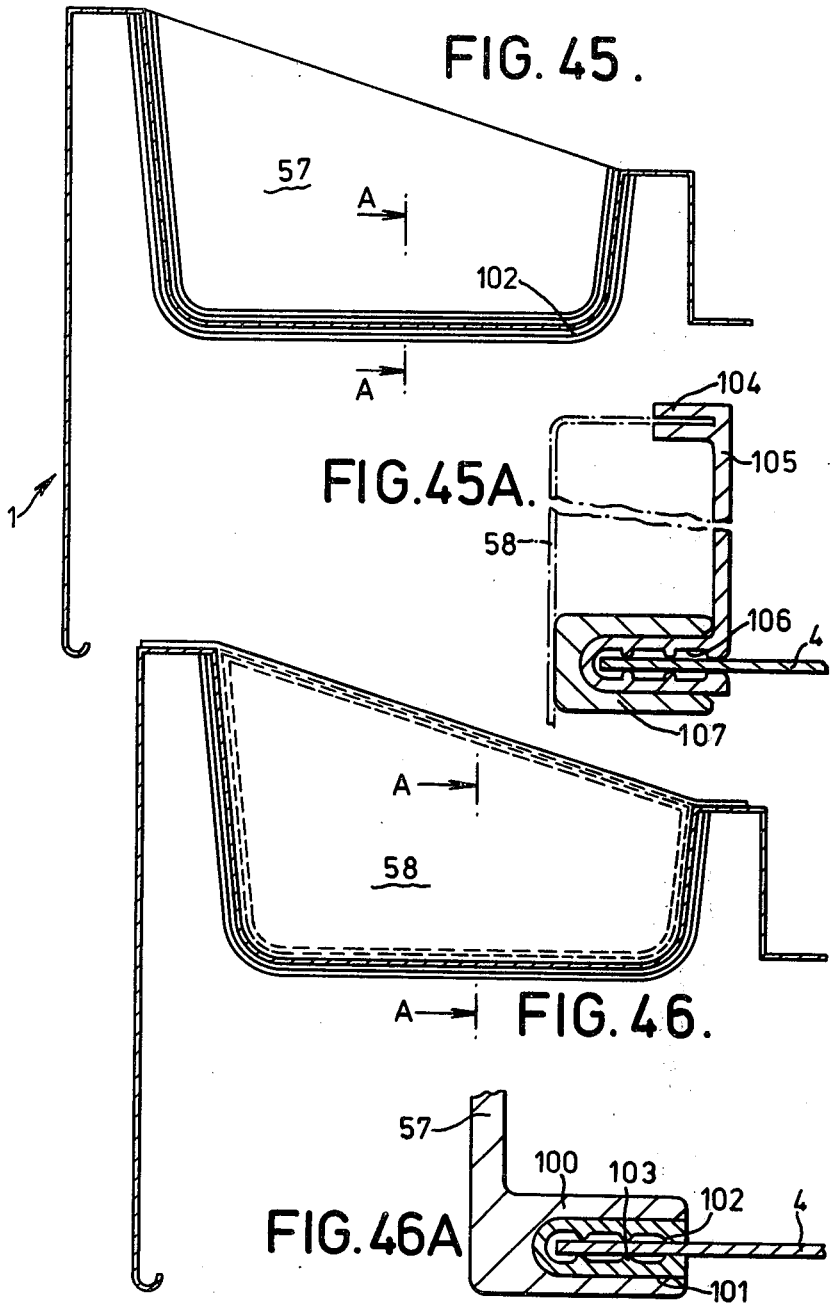

FIGS. 34 and 34A respectively show a front elevational and vertical sectional view (on the line A—A of FIG. 34) of an outlet member in position in the unit;

FIGS. 35 and 35A show respectively a front elevational and vertical sectional view (on the line A—A of FIG. 35) of a straight connector;

FIGS. 36 and 36A (a view in direction of arrow "A" of FIG. 36) show details of a barge board for use with the unit;

FIG. 36B is a perspective view of an apex piece for a barge board;

FIGS. 37 and 37A show an end cover for a soffit, FIG. 37A being a section on the line "A—A" of FIG. 37;

FIGS. 38 and 39 are respective perspective views of an internal and an external corner member for the unit;

FIGS. 40 and 41 are respective perspective views of other external and internal corner members;

FIGS. 42 and 42A are respective vertical views, FIG. 42A being on the line A—A of FIG. 42, showing the construction of the outlet member and connector (FIGS. 44,45 respectively);

FIGS. 43 and 43A are respective vertical views, FIG. 43A being on the line A—A of FIG. 43, showing the construction of an alternative outlet member and connector;

FIGS. 44, 44A and 44B are views of a further construction of outlet member, and connector;

FIGS. 45 and 45A are sectional views of an end stop seal, FIG. 45A being taken on the line "A—A" of FIG. 45;

FIGS. 46 and 46A are sectional views of a further construction of end step seal, FIG. 46A being taken on the line "A—A" of FIG. 46; and FIG. 47 shows a schematic end elevation of a further assembled unit in position on a roof.

Referring to the drawings, in which like parts are referred to by like numerals, there is shown a gutter-fascia-soffit unit 1 comprising an integral fascia and gutter member or element 2 made from galvanised mild steel, plastics, or metal coated with plastics, and a soffit board 3 made of similar materials and which has an undulating profile as shown in FIG. 1, although it could be planar.

The respective materials may alternatively be 18g pressed steel with a colour coat finish and 20g pressed steel with a colour coat finish.

The channel-shaped gutter and fascia member 2 comprises a gutter 4 having a right hand lip 5 which forms a tilting member in use, and a left hand lip 6 (as seen in FIG. 1) higher than the right hand lip and extending round substantially parallel with the left hand gutter side to form a fascia or panel 7, which terminates in means 8 in the form of a hook which can hook over a lip 9 on the soffit board 3.

The gutter can include a rain water outlet pipe 10 of 2½ inches diameter and made from pressed steel, the pipe being welded to the circumference of a hole in the gutter base and extending downwardly to beyond the level of the soffit (FIG. 4).

Alternatively, the outlet pipe 10 may be welded to a gutter bracket 11 which is welded to the pipe and has a profile complementary to that of the gutter part of the fascia and gutter member so that the bracket 11 fits snugly inside the member in use, and is secured in place by eight mushroom headed bolts 12 (FIG. 5). A 2½ inches diameter hole is cut in the base of the gutter 4 during manufacture or in situ during construction of a building (FIGS. 1 and 5).

FIGS. 2 and 3 show the unit in position at eaves of different overhangs. The tilting member in each case supports the roof tiles and roofing felt and is secured to the upper side of a joist at one position only by a nail or pin 13.

The soffit board is pinned or nailed to the underside of the joist. In FIG. 3, two overlapping soffit boards 3 and **3*a* are required to accommodate the longer overhang, a pin 14 forced through the overlapping soffits into the joist 15** securing them in position.

When two units are to be placed together so that the two fascias comprise a substantially continuous, planar surface, the two adjacent edges of the members are received in a respective one of two grooves forming part of a polyvinyl chloride cover joint strip 16 of the kind shown in FIG. 1A, the strip having two lugs 17 which bear on the front surface of a respective fascia 7 and seal the adjacent groove, and a backing element.

The ends of a straight run of gutter, fascia and soffit are closed by left and right hand end stops 18 which are made of pressed steel, colour coated, or of moulded polyvinyl chloride or other plastics and which have a push fit over and enclose the end of the fascia, gutter and soffit board, which is planar in FIGS. 6 and 7.

The respective end stop is planar at substantially 90° to the length of the gutter and has top, side and bottom extensions which engage the unit. The gutter/fascia extends beyond the lateral extent of a roof, and a timber or steel verge board or joint strip is engageable between the end of the gutter and the planar face of an end cap (FIG. 6).

FIG. 8 shows an exploded perspective view of the fascia and gutter, including end stops 18, connecting brackets 19 for connecting together adjacent lengths of the fascia and gutter, a connecting bracket 11 including a rainwater outlet 10, all the brackets having internal dimensions corresponding with the external dimensions of the gutter 4, and an end cover 20, which has an open side 21 which can receive a barge or verge board. The fascia and gutter members 1 may suitably have lengths of 2 feet, 3 feet, or 8 feet, the brackets 19 may be 4 inches long, and a bracket with an outlet pipe may be 10 inches long and be mounted in a fascia and gutter which is 6 inches long. The end stops may be 2 inches long. In every case, the brackets and end stops engage externally of the fascia and gutter, the two shapes of the two members being complementary. A jointing compound can be placed on the engaging surfaces. The engagement is shown in FIG. 9, while FIG. 10 shows an end plate 22 which is the essential part of the end stop 18, the plate 22 being welded to or formed integral with the bracket.

Figure 11:
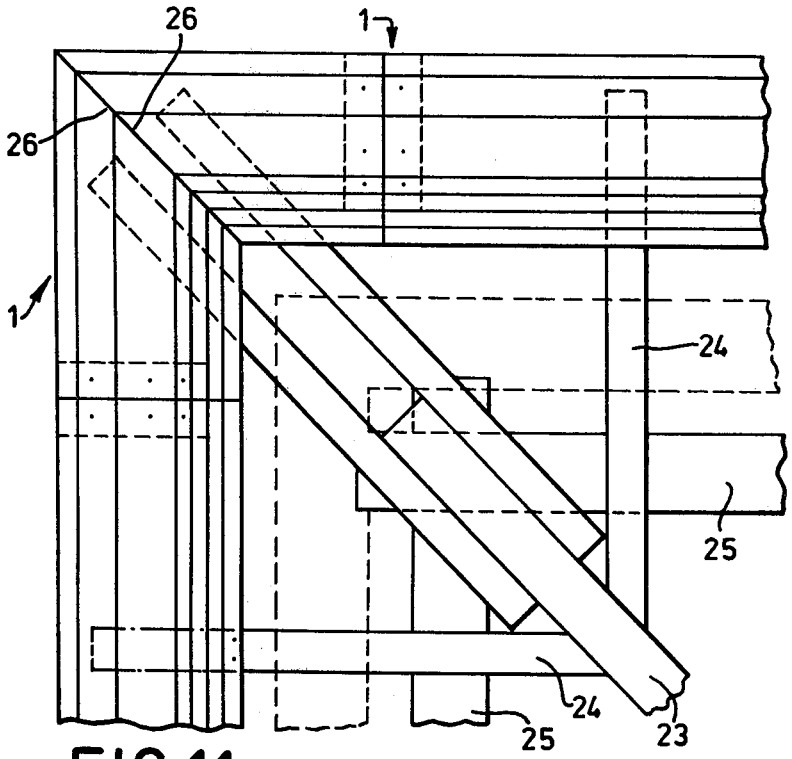
FIG. 11 shows a plan view of a corner of a roof.
Figure 12:
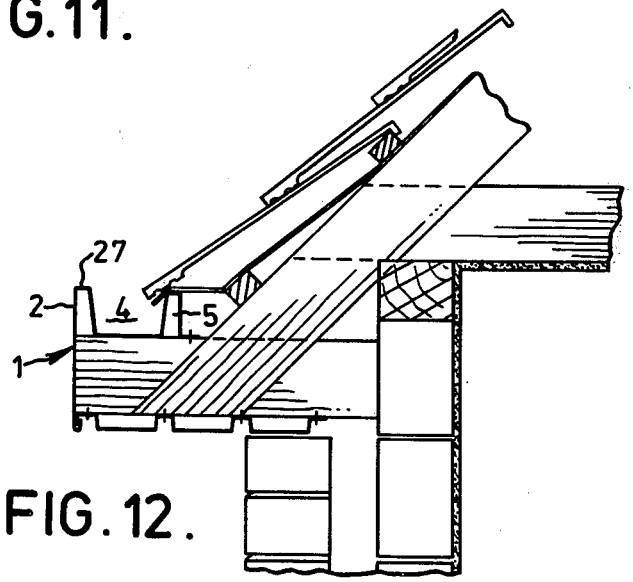

FIG. 11 shows a plan view of a corner of a roof in which lip and jack rafters 23,24 are shown, together with wall plates 25. The fascia and gutters 1 which are to be used at corners are mitred at their ends 26 to abut at 45° to provide a 90° external corner. It will be understood that different corner pieces will be required to accommodate particular internal and external corners.

FIGS. 12, 13, 14 and 16 correspond to FIGS. 2 and 3 and show an integral gutter and fascia member 1 in position respectively at the eaves of a roof having a 45° slope, 25° slope, 17½° slope, and 25° slope with an 18 inch instead of a 9 inch overhang. As is clear from the Figures, the right hand lip or edge 5 of the gutter acts as a tilting member or fillet supporting the roofing tiles, the left hand edge including a bridge 27 which is integral with the fascia 2. The connecting means 8 engages the lip 9 on the soffit board 3 in each case to form a hinge or pivot so that the individual elements of the unit can be mounted on any pitch roof.

FIG. 15 shows an end elevation of the end cover 20, with a barge board 28 seated in the open side or slot 21.

FIG. 17 shows a perspective exploded view of a gutter section including an internal view of the left hand end cover 20 (the right hand one is identical) an external 90° corner member 29′ and an internal 90° corner member 29, both of which have a profile corresponding to that of the integral fascia and gutter and carry rainwater round the corners.

Figure 20:
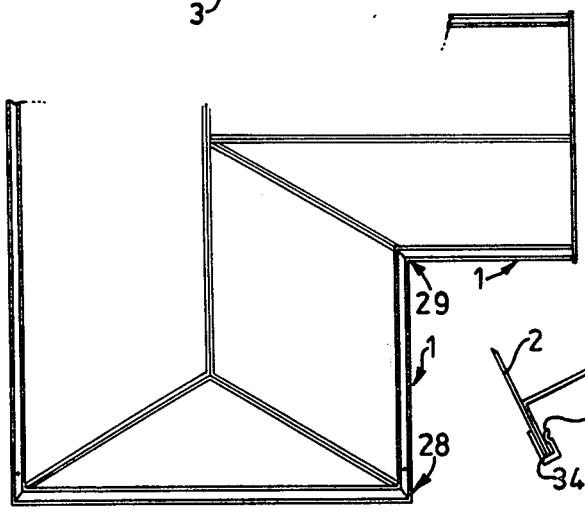
FIG. 20 shows a plan view of a house roof.

A plan view of the fascia and gutter member of FIG. 17 is shown in plan view in position on a building in FIG. 20.

Figure 19:
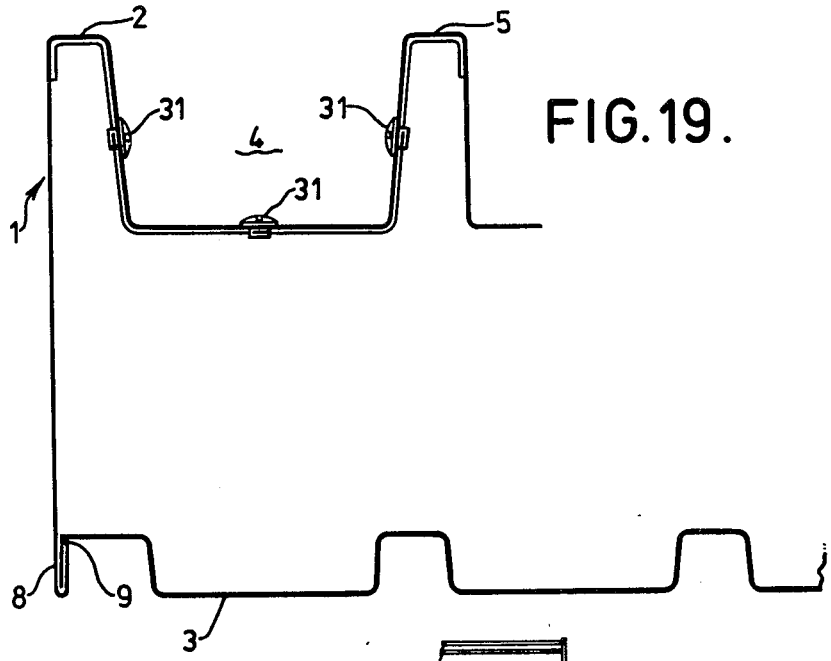
FIG. 19 shows a detail mounting to a bracket.

FIG. 18 shows an outlet pipe connected to a drain pipe 30 (in dashed lines), the outlet pipe extending through the soffit board. FIG. 19 shows a view similar to that of FIG. 1 but illustrating self-tapping screws 31 used positively to interconnect the fascia and gutter member with a gutter bracket.

Figure 21:
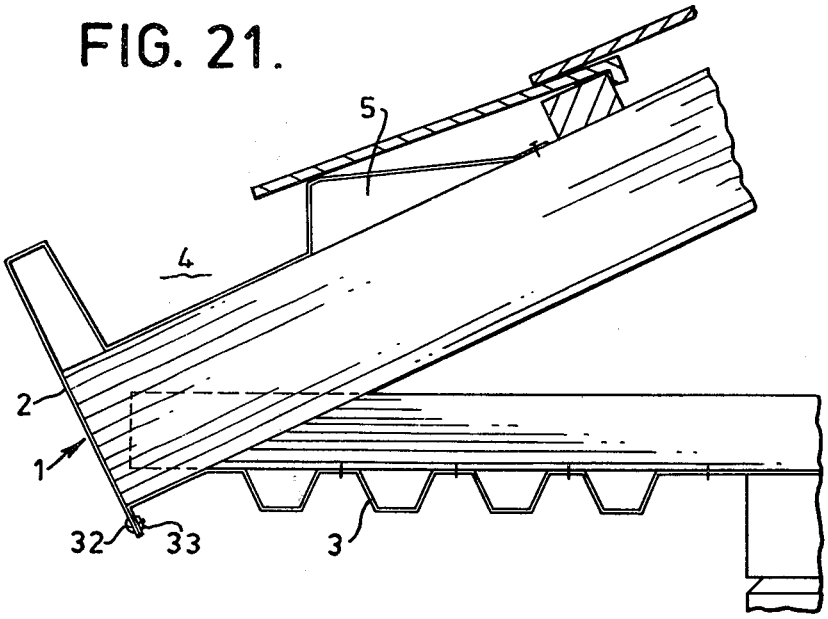

FIGS. 21 to 23A show means different from the hook of FIG. 19 whereby the fascia and soffit are connected. In FIG. 21 mushroom head joint bolts 32 secured by nuts 33 secure the fascia to the soffit. The nuts and bolts are used at 16 inch centres.

Figure 22:
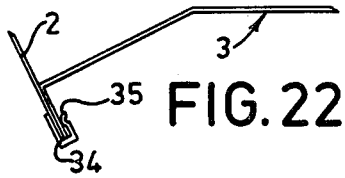
FIGS. 21 to 23A show different means for securing a gutter member to a soffit.

In FIG. 22, there is shown a plastics, metal, for example steel, or metal and steel J-shaped clip 34 which extends the length of the gutter. A spring lip 35 on the clip ensures a tight engagement.

Figure 23:
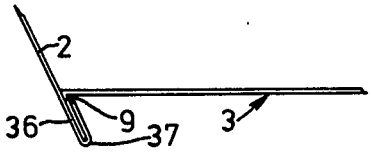

FIG. 23 shows a push fit full length fascia section 36 which is bent over the lip 9 of the soffit as shown at 37.

Figure 23A:
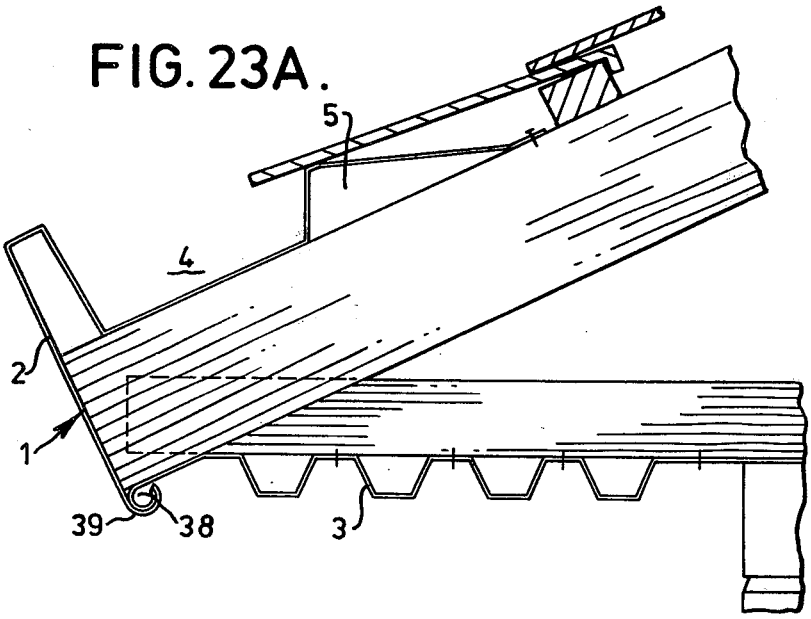

FIG. 23A shows schematically a hinge or pivot between the fascia-gutter member and soffit which comprises hinge or pivot means in the form of a roll lip 39 on the fascia engaged with a roll hip 38 on the soffitt so that a hinge effect is obtained whereby different angles of pitch of the roof can easily be accommodated.

Figure 24:
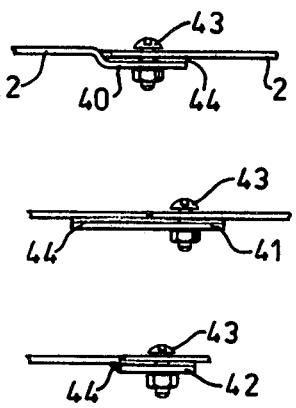
FIG. 24 shows several joints between adjacent gutter and fascia members.

FIG. 24 shows three different joints for use between adjacent fascia and gutter member. In the first, one member has an offset end portion 40 which accommodates a plane end of the adjacent member. In the second and third, both ends are planar, a backing plate or bar 41 or 42, being used. In every case, the joint is secured by a nut and bolt 43, and jointing compound 44 is placed between the abutting members.

Figure 25:
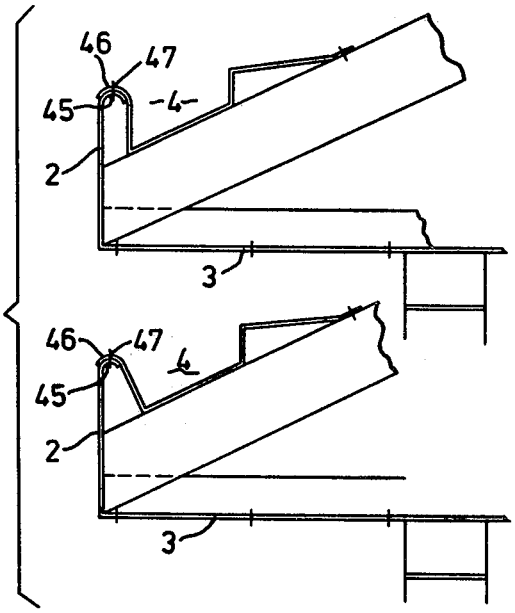
FIG. 25 shows an alternative form of gutter and fascia member for a roof of any slope.

FIG. 25 illustrates a combined fascia, gutter and soffit in which the fascia 2 and soffit 3 are integral, a top 45 of the fascia being rounded and received within a corresponding rounded edge 46 of the gutter member 4. The two rounded sections 45 and 46 are locked with self tapping screws 47 where they overlap. This construction provides an automatic accommodation for roofs of any slope since the overlapping rounded sections define a hinge or pivot and can be rotated relative one to the other, as the slope requires, during construction. The right hand edge of the gutter defines the gutter and also functions as a tilting fillet to support tiles etc.

Figure 26:
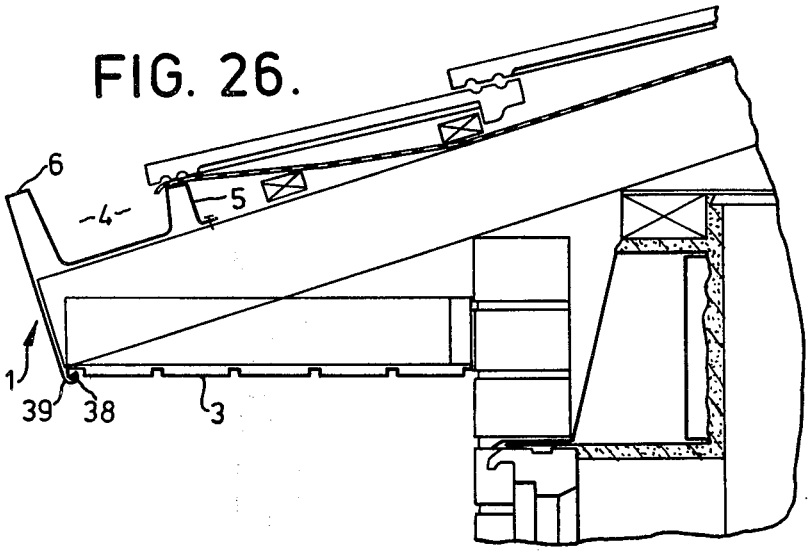
FIGS. 26 to 26L show respectively details of a gutter-fascia-soffit unit when assembled from first and second members on roof pitches of 17½°, 20°, 22½°, 25°, 27½°, 30°, 32½°, 35°, 37½°, 40°, 42½°, and 0°.
Figure 26A:
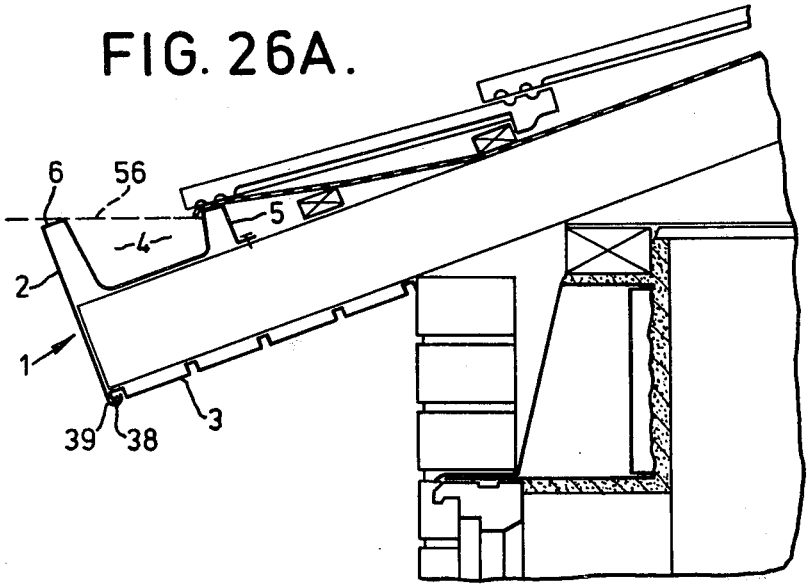
FIGS. 26M,26N and 27 show respectively level fixings of the unit to a pitched roof.
Figure 26B:
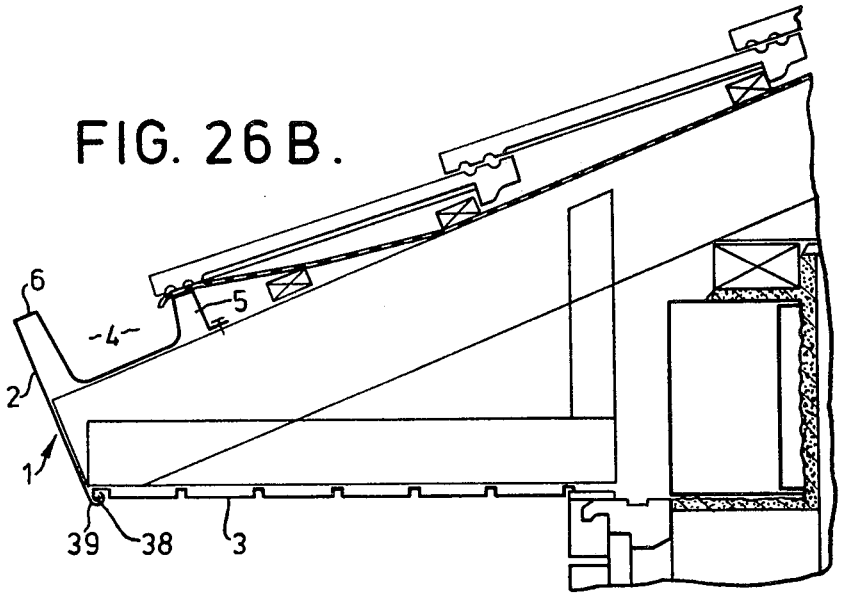
Figure 26C:
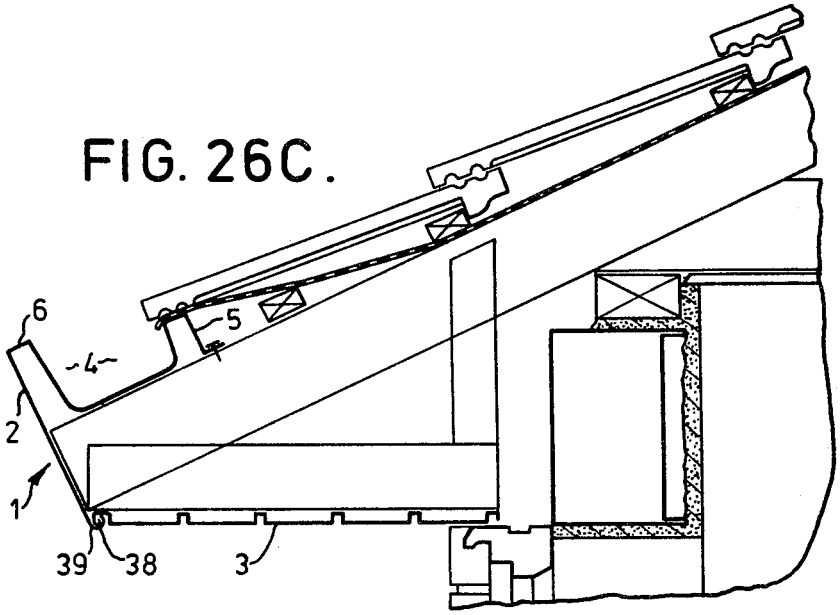
Figure 26D:
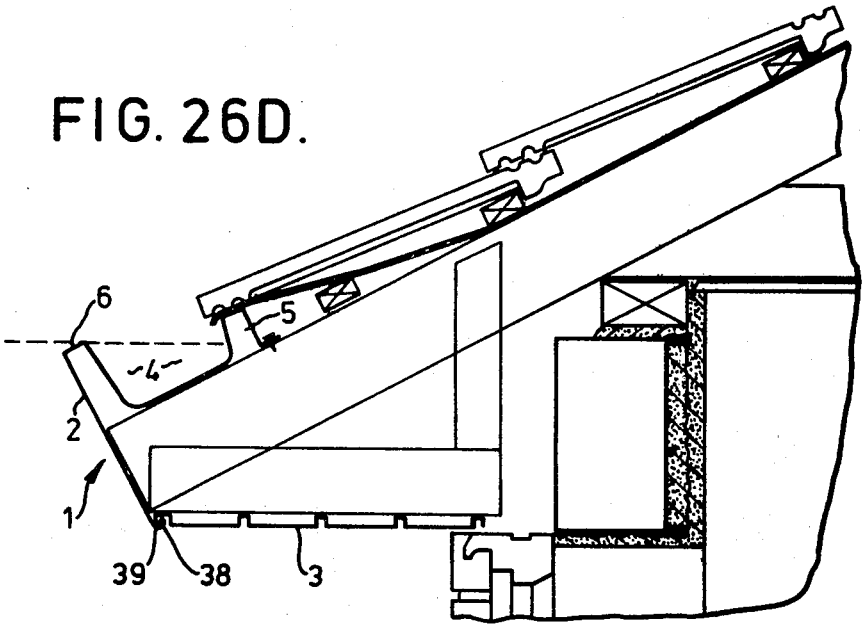
Figure 26E:
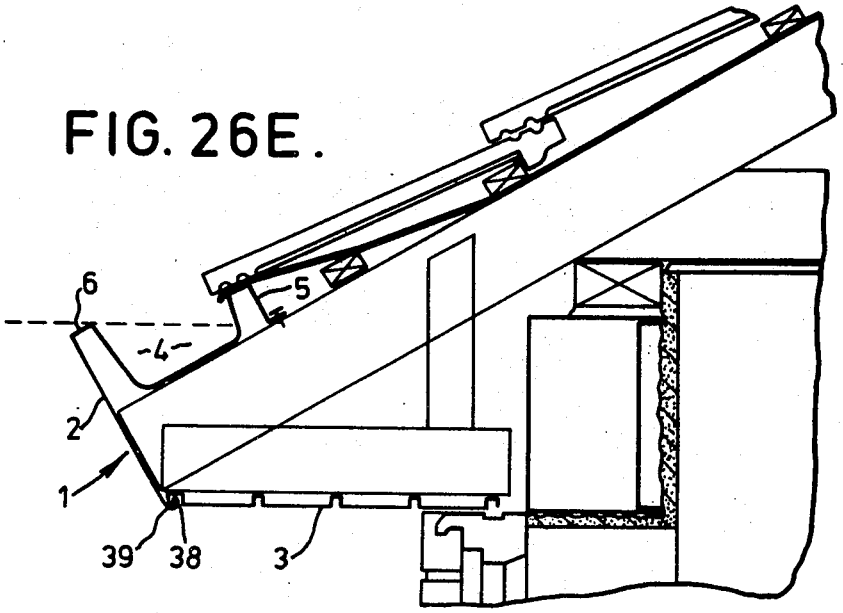
Figure 26F:
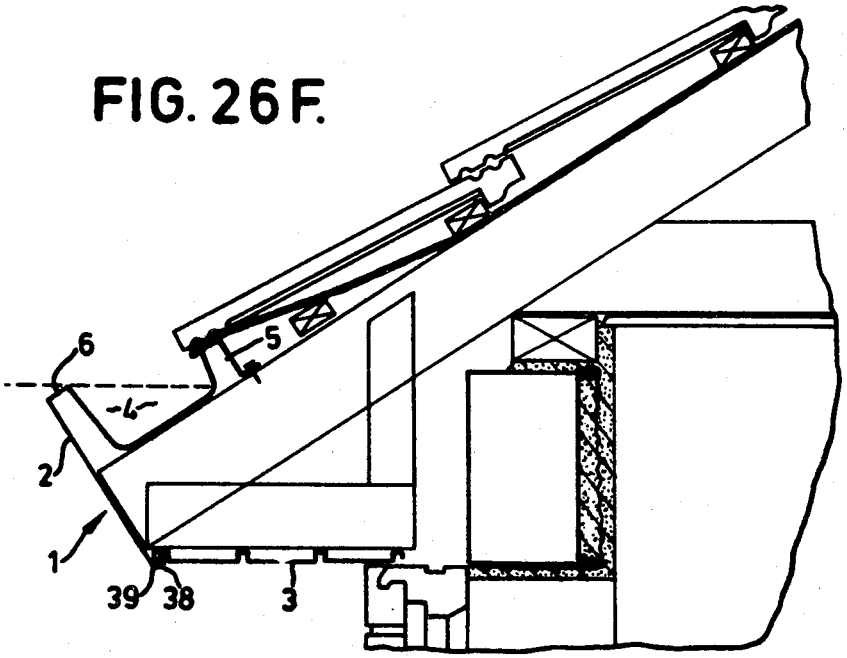
Figure 26G:
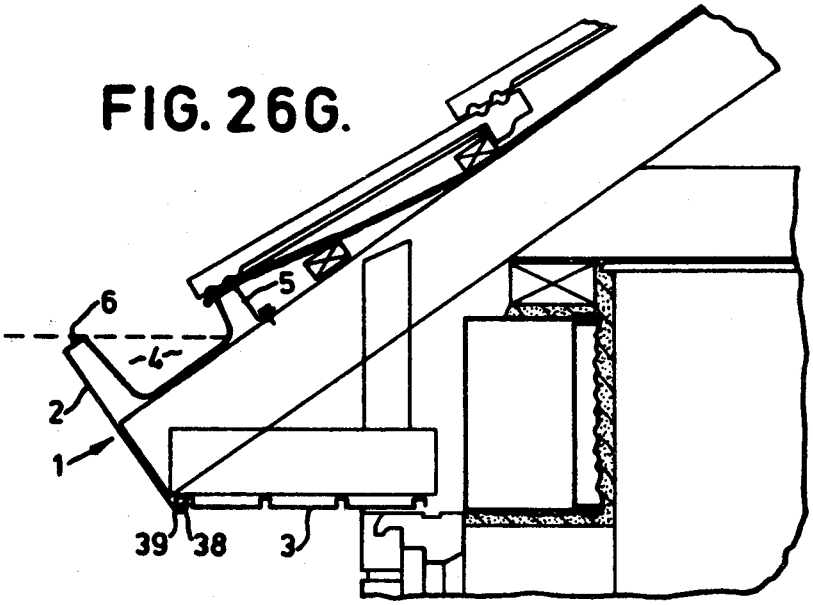
Figure 26H:
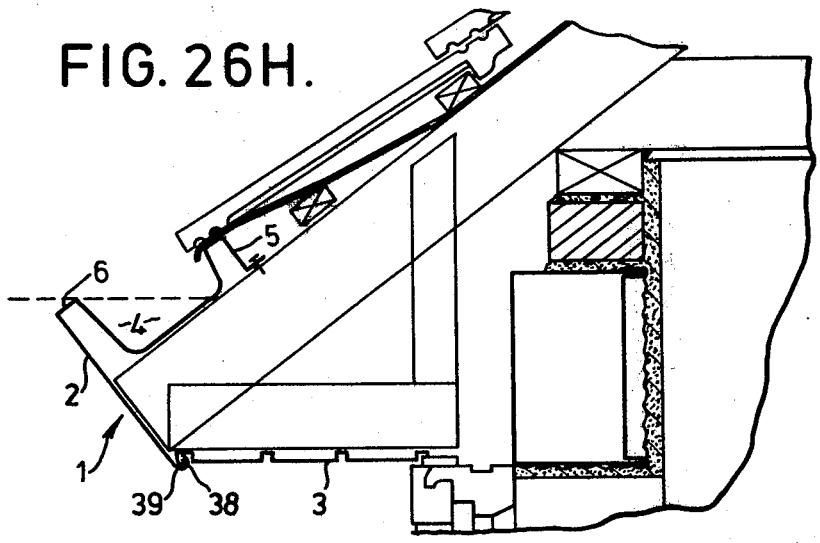
Figure 26I:
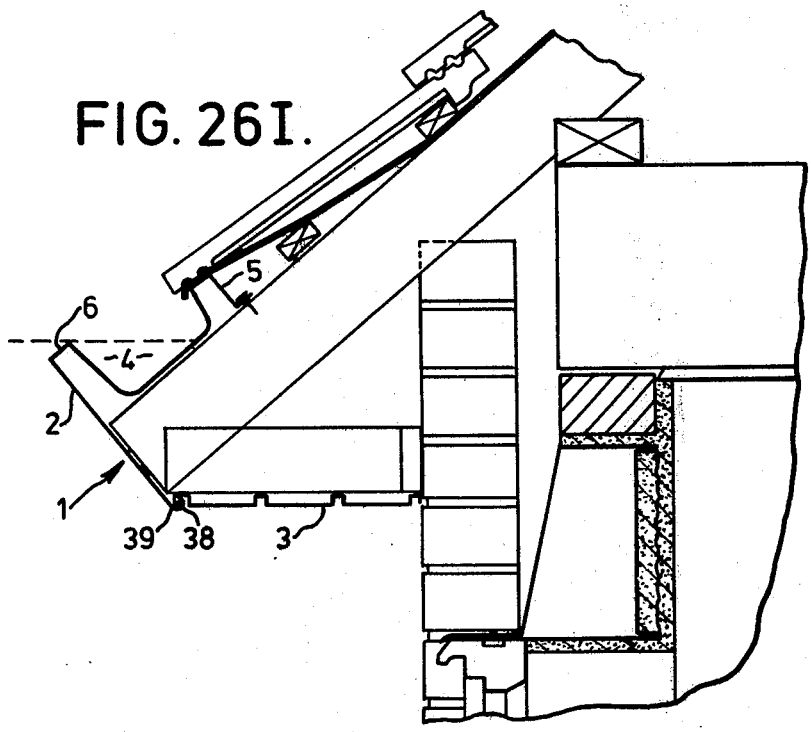
Figure 26L:
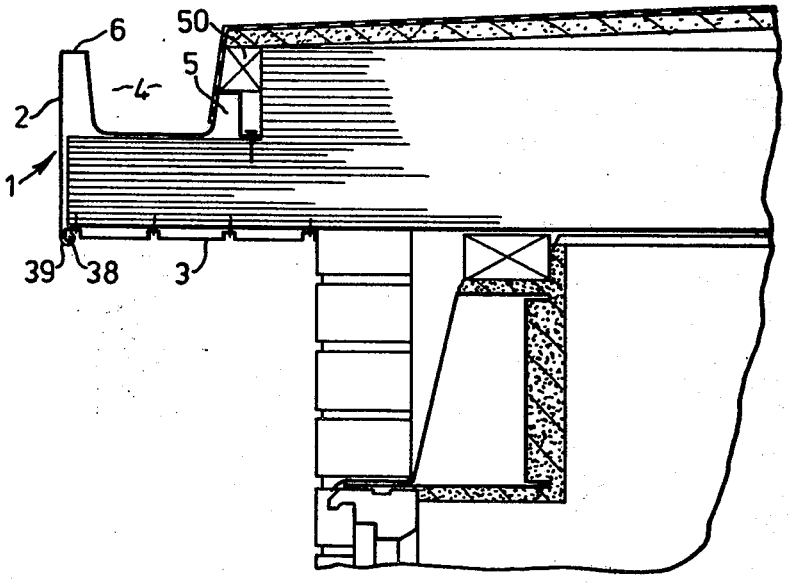

FIGS. 26 to 26L show detail sections through the gutter-fascia-soffit unit 1, comprising a first member comprising gutter-fascia member 5,4,6,2 combined with a second member comprising a soffit member 3, mounted on a range of roof pitches from flat (FIGS. 26K and 26L) to 42½°.

In each case, the soffit member 3 is pinned to the rafters so that its roll lip 38 is free and then the gutter-fascia member 5,4,6,2 is mounted on it by pushing the roll lip 39 over the roll lip 38. The member 5,4,6,2 can then be adjusted in position according to the roof pitch by pivoting the lip 39 relative to the lip 38. The two lips thus form a hinge or pivot.

The flat roof of FIG. 26L is higher than that of FIG. 26K, the tilting member 5 supporting an additional beam or joist 50.

Figure 26M:
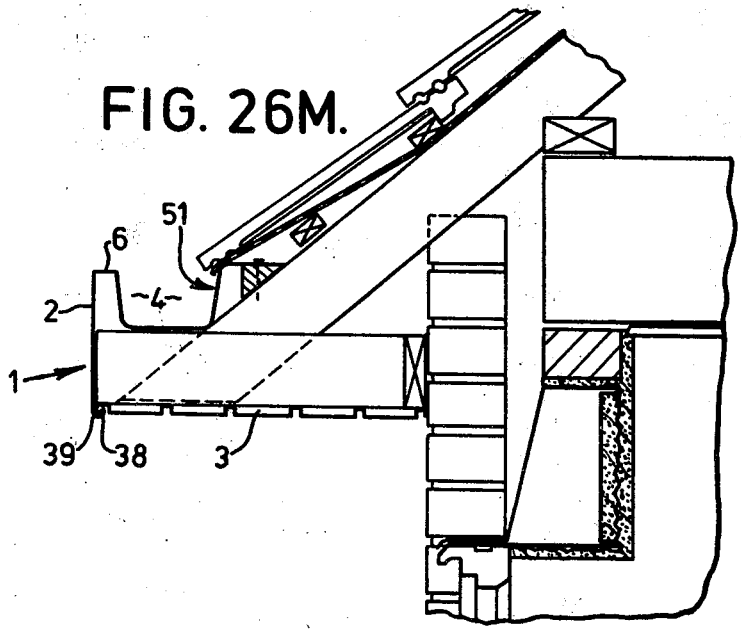

FIG. 26M shows a detailed vertical section through a level fixing of the unit to a pitched roof, the tilting member in this case being modified as shown by numeral 51. Its right hand edge, as shown, is substantially parallel to the soffit 3 and is pinned to a rafter.

Figure 26N:
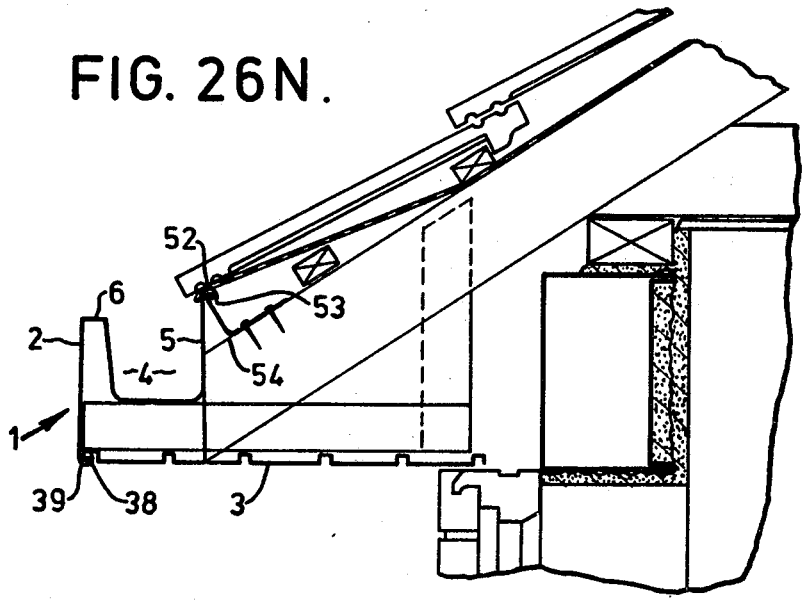
Figure 27:
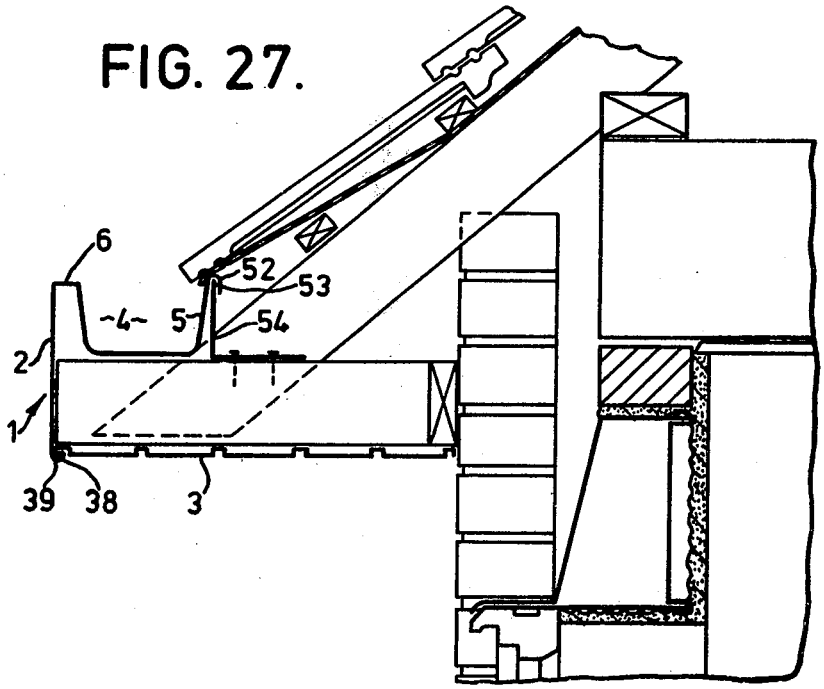

FIGS. 26N and 27 show vertical detail sections through alternative level fixings of the unit to a pitched roof. In FIG. 26N, the tilting piece 5 terminates in a roll lip 52 which is in pivotal engagement with roll lips 53 of brackets 54 pinned one to each joist. FIG. 27 is similar, except that the brackets 54 are pinned to the upper side of the sprockets, the soffit 3 being secured to the underside of the sprocket.

FIG. 27A shows a modification in which the soffit is not used and the gutter-fascia member is flush with an outer wall of the building. In this case, the roll lip 39 is engaged with a roll lip 38 to form a hinge or pivot, the lip 38 being part of a bracket 55, there being one bracket 55 per joist.

The water level 56 in the gutter 4 is shown, in FIG. 26A for example, as a dashed line. The gutter of the unit embodying the invention is designed to carry a water volume for the greatest roof pitch which is greater than the standard 4 inch by 2½ inch half-round gutter.

In every embodiment, the roll lip 39 is substantially circular.

Figure 29A:
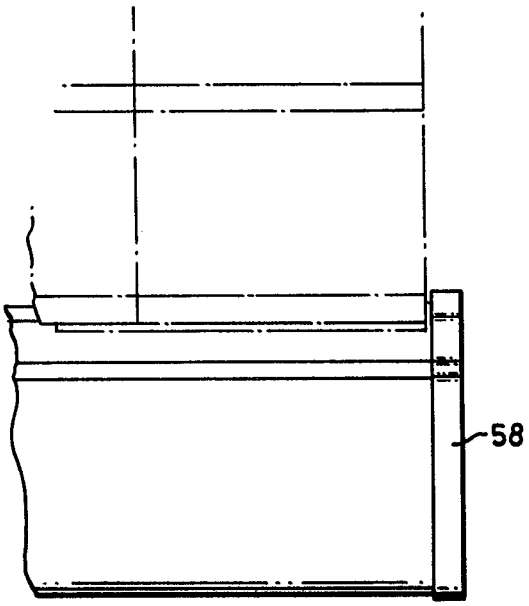
FIG. 29A shows a side elevation.
Figure 29:
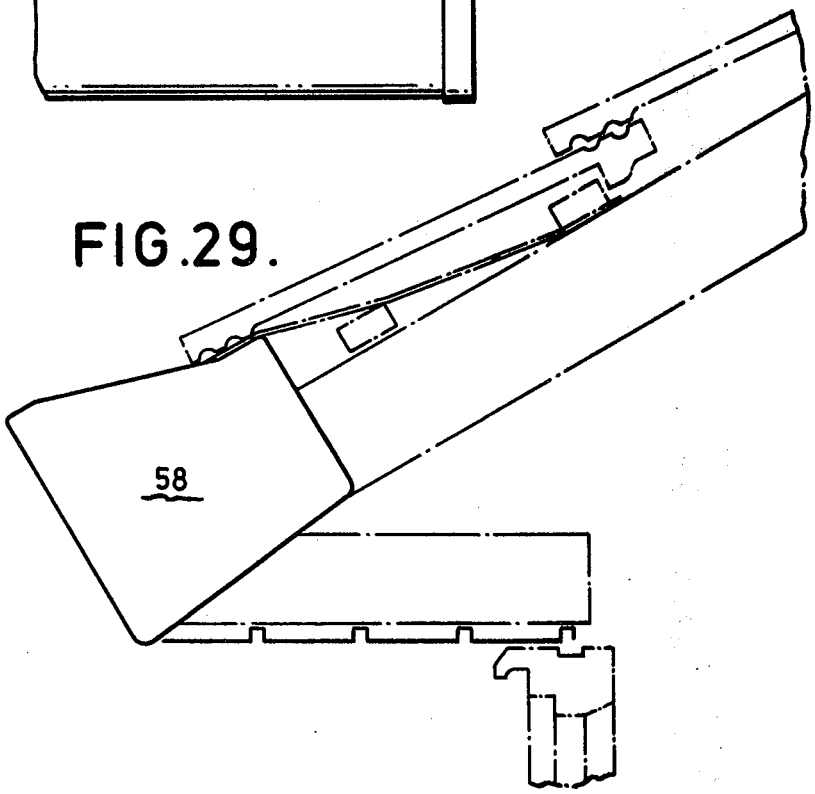
FIG. 29 shows an end elevation of a cover plate mounted on the unit.

The end of a straight run of gutter 4 requires a stop end seal 57 as shown in FIGS. 28 and 28A. It is made of moulded polyvinyl chloride/Neoprene and is a push fit in the end of the gutter, flanges 57*a* engaging internally of the gutter. The end stop is covered by a cover plate 58 (FIGS. 29 and 29*A*) which is a push fit externally of the gutter-fascia member and is preferably made of colour coated steel of the same colour and finish as the unit 1.

In order to prevent the elements penetrating under the eaves of the building to the rear (right as viewed in FIGS. 30 and 30A) a J-shaped rear cover plate 59 is pushed in the longitudinal direction of the unit in the direction of the arrow in FIG. 30A to cover off the rear of the unit. The plate 59 engages with its lip 60 over the tilting member, a retaining block 61 positioning the plate 59.

Figures 31, 31A:
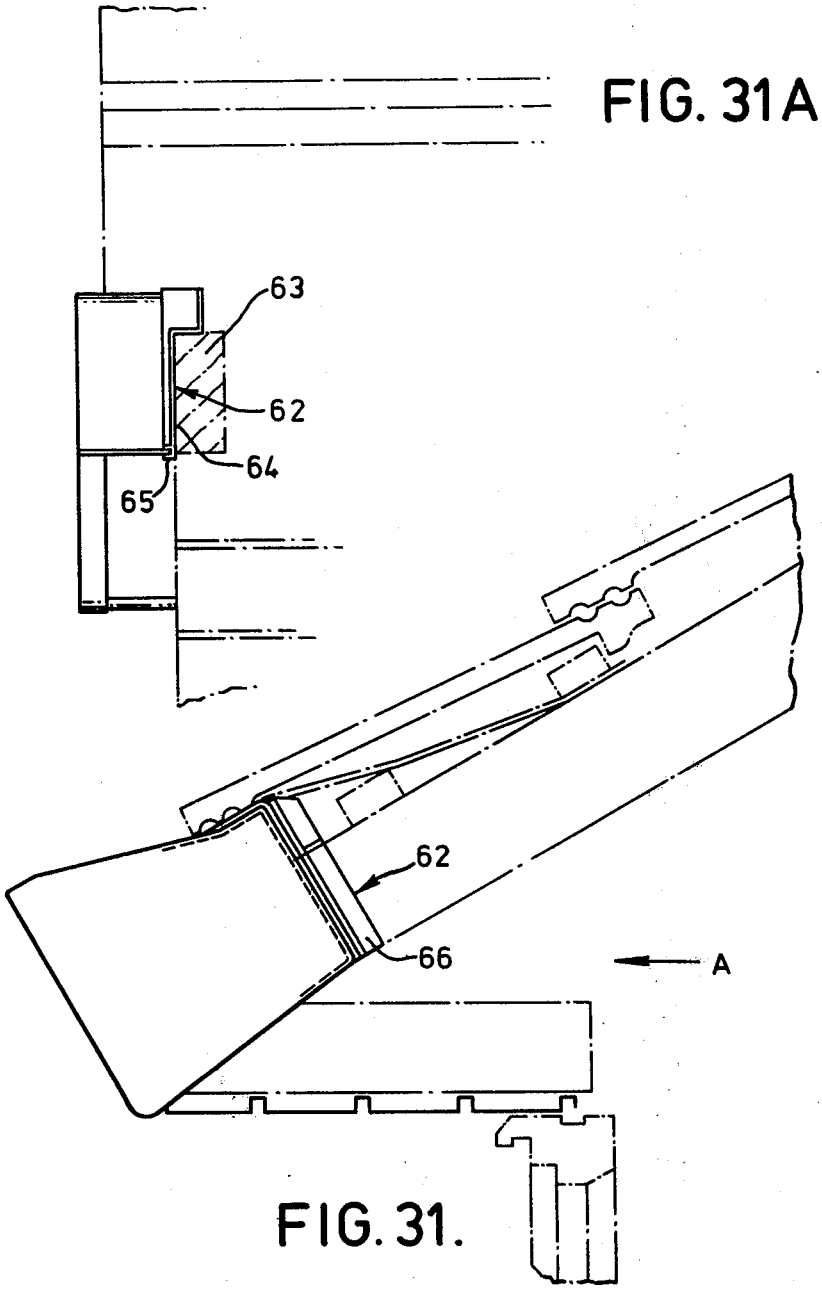
FIGS. 31 and 31A show an end stop cover seal and a rear cover seal, FIG. 31A being a view in the direction of the arrow "A"

A rear cover corner seal 62 is shown in FIGS. 31 and 31A and comprises a plastics moulding nailed to a joist 63 at the corner of the building, a limb 64 having a bifurcated part 65 for engaging a rear cover 67. The seal 62 presents a flush external surface 66.

The rear cover 67 and a bottom cover 68 (FIGS. 32 and 32A) are also used to provide a smooth surface finish under the unit and in the eaves. The cover 67 is of J-shape and is made from colour coated steel. It is cut to the correct length for a particular run of guttering, and clips into the bifurcated part 64 of the corner seal. The bottom cover 68 is made of plastics material by extrusion. It too is cut to the desired length, and is clipped in position by resilient lugs 69 which engage inside the member 2, as more clearly shown in FIG. 33.

Figure 33A:
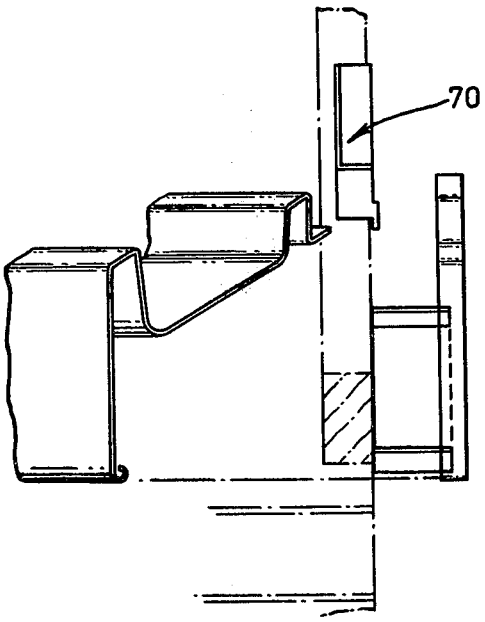
FIGS. 33 and 33A show details of a sprocket filler piece, FIG. 33A being a vertical sectional view of the arrow "A" of FIG. 33.
Figure 33:
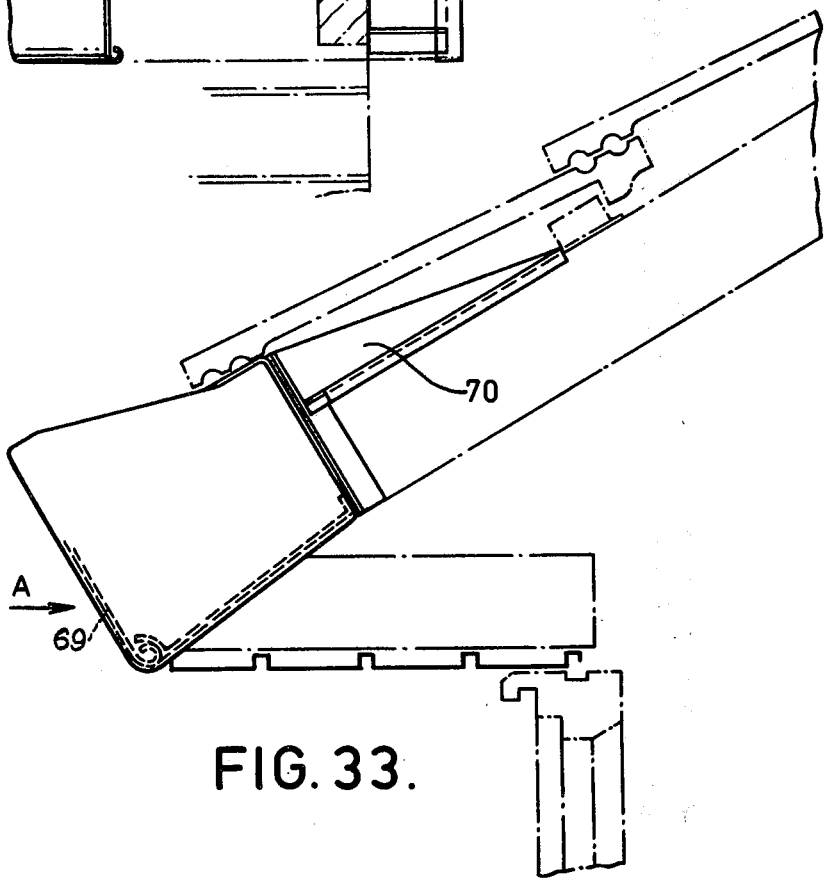

Finally, FIG. 33 and 33A show a sprocket filler piece 70 of triangular configuration which is moulded from plastics material and is nailed or pinned to a joist to fill in the space between the underside of the roof tiles and the unit.

FIGS. 34 and 34A show a downpipe or outlet piece 71 in position in the unit. The outlet piece 71 is positioned in the unit to connect with a downpipe 72 of the building and has two edges 73 in which adjacent gutter-fascia-members are received to provide a continuous run when assembled. The outlet piece 71 has a similar cross-sectional configuration to that of the gutter-fascia member, and includes a flexible downpipe portion 74, suitably of polyvinyl chloride for linking with the downpipe 72. The flexible nature of the portion 74 enables the outlet piece to be used on any roof pitch. The outlet piece 71 is suitably made of moulded plastics. It is used with a separate soffit filler piece 75 to give access to the outlet from below.

A straight connector 76 (FIGS. 35,35A) for two units has two edges 73 (similar to the outlet piece 71) for receiving ends of adjacent gutter-fascia-members and has the same cross-sectional configuration as the members.

Both the outlet piece 71 and the connector 76 have a roll lip 77 for engaging over the roll lip 39 of the fascia 2.

A barge board 78 as shown in FIGS. 36 and 36A is used with the unit 1 and is a channel shaped member having a lip 79 which with a fillet 80 finishes off the edge of a roof flush with the roof tiles 81. Limbs 82 of the barge board are nailed to the joist 84, the limbs 82 and the web 83 forming a covering for the joist. A soffit section 85 is only used for extended verges. Bargeboards 78 meeting at the apex of a roof are connected by a "V"-shaped apex member 86 which has the same general configuration as the bargeboards, which engage as a push-fit therewithin (FIG. 36B).

A soffit end cover 87 is used to finish off the triangular space left between the unit 1 and the wall at the end of a run of the unit. It comprises a colour coated steel member nailed to the joist and including a lip 88 for engaging under (as viewed in FIG. 37A) the bottom cover plate.

FIGS. 38,39,40 and 41 show respectively an internal corner member 89 for a flat roof, an external corner member 90 for a flat roof, an external corner member 91 for a hipped roof and an internal corner member 92 for a hipped roof. Each member 89 to 92 corresponds in cross-section with the gutter-fascia member, and has two edges 93 within which each member is received as a push fit. In use the right hand edge of one member 2, for example the left hand one in FIGS. 38 to 41, is pushed into engagement with the left hand edge 93, while the left hand edge of the other (right hand) member is pushed into engagement with the right hand edge of the member 89,90,91 or 92. The corner members are made from plastics mouldings or colour coated steel and have a bottom roll lip (not shown) which can engage round the roll lip 39 of the members 2 so that any angle can be accommodated.

FIGS. 42 and 42A show detailed construction of the straight connector 76 (FIGS. 35,35A). The edges 73 have a channel 93 in which is mounted an extruded expanded neoprene seal 94 of U-shape. When edges of gutters 4 are to be joined in a straight run by the connector 76, one gutter (left hand) is pushed into the channel between the limbs of the seal 94 in the channel 93, and then the other gutter is pushed into its sealed channel in the connector. The seal closely grips the respective gutter and secures it in position as well as sealing it against leakage of water from the inside of the gutter to the outside. The connector has strengthening webs 95. The outlet piece 71 has a similar seal.

An alternative seal 96 is shown in FIGS. 43 and 43A and comprises an extruded expanded neoprene seal or gasket in a channel in an edge 73 of the connector.

A further form of connector is shown in FIGS. 44 to 44B. This connector is similar to those previously described but the inner surface over which the water flows is profiled to provide channels 97 through which the water can easily flow from one gutter to another connected by the connector. The channels are separated by buttresses 98 for strength and the side wall is thickened at 99.

The end stop 57 has a foot 100 (FIG. 46A) within a channel 101 of which is a neoprene seal 102 which in use seals against the tilting piece-gutter-fascia member 1. The foot 110 may itself have nibs (not shown) similar to those 103 of the seal 102 to form pressure points on the seal 102 and so enhance the sealing effect.

The cover plate 58 is secured by engagement in a channel 104 of a neoprene seal 105 which corresponds in cross-section with the gutter 4 of the member 2, the gutter 4 engaging in a channel 106 of the seal, which is clamped in position by a separate or integral clamp 107.

FIG. 47 shows an embodiment in which the right hand edge of the gutter 4 comprises an inclined member 108 leading to the tilting member 5. The tilting member 5 is arranged to be able to receive a piece or pieces of wood or metal 109 comprising fillets. In mounting the member, the lower slate or tile is raised and the tilting member 5 is pushed over the fillet 109, and the tile is then lowered.

It will be understood that the tilting member is integral with the gutter. By tilting member in this Specification is meant a projecting or upstanding part of the first gutter member which is located on the side of the gutter member remote from the fascia and adapted to bear upwardly against roofing units such as tiles or slates or boards when the same are in position with their edges extending beyond the tilting member so as to cause rain water to flow into the gutter. Preferably, the tilting member is in use so positioned as to cause the lower course of tiles, slates boards or the like to be tilted slightly upwardly in relation to the adjacent higher courses — see FIG. 26 for example.

In every embodiment, the soffit member or the gutter member can be fitted first. It is pinned at one position to a rafter, and the other member is then positioned and is pinned, at only one position, for example through the lip of the gutter, the hook (FIG. 1) engaging the lip of the soffit to connect the two members securely together.

The guttering is built up to any required length using this simple technique. In every case, it will be understood that the gutter is completely hidden, the only visible member being the fascia, which thus conceals the gutter and the soffit.

It will be understood that the soffit may not be used and that the bridge 27 and the lip 5 may be of any desired configuration.

The system described has the advantages of:

i. substantially halving the cost of traditional systems.

ii. cuts labour costs on site and increases speed of building.

iii. cuts the dependency on timber, and enables costs and supplies to be standardised since a range of tilting member-gutter-fascia, and soffit modules may be bought, stored and used as required, since the unit can be used on any particular slope of roof.

I claim:

1. Members of a combined fascia-soffit-gutter unit for the dispersal of rainwater from a roof of a building, comprising a preformed first member including a gutter portion and first hinge means, said first member also including a fascia portion, and a preformed second member including a soffit portion and second hinge means complementary to said first hinge means, whereby when the first and second hinge means are connected a hinge is formed so that said first member and said second member are connected for relative angular movement with respect to one another and comprise said combined fascia-soffit-gutter unit, and said first member further including a tilting portion integrally connected to the gutter portion at a part thereof remote from said fascia portion, said tilting portion being adapted, when used in connection with a sloping roof, to support a lower end of a tile of the roof in the course of tiles nearest said first member.

2. The members as defined in claim 1, wherein said first and second hinge means are located at an extremity of said respective first and second members.

3. The members as defined in claim 2, wherein said first and second hinge means each comprise arcuate components so arranged as to be adapted for a push-fit engagement one with the other for effecting said relative movement between said first and second members.

4. The members as defined in claim 2, including securing means, said securing means being adapted to pass through said first and second hinge means to secure the first and second members against further relative movement after they have been moved relative to one another to a desired extent.

5. Members as defined in claim 1, wherein said tilting portion is a generally inverted channel section portion.

6. Members as defined in claim 5, wherein said tilting portion is adapted to engage means joined to roof members of a building, whereby said unit is maintained in position at said roof.

7. Members as defined in claim 5, wherein said tilting portion includes a hinge portion at an upper end thereof, said hinge portion being remote from said first hinge means of said first member.

8. Members as defined in claim 1, wherein there is end stop seal means adapted for a push-fit engagement with said first member.

9. Members as defined in claim 1, wherein said first member wherein there is cover plate means adapted for push-fit engagement with the first member to cover one end of the unit when assembled.

10. Members as defined in claim 1, wherein there is rear cover plate means, said rear cover plate means being adapted to cover in use a side of the unit remote from said fascia portion, said rear cover plate means having a substantially J-shape having hook end means for engagement with said tilting portion.

11. Members as defined in claim 1, further including a rear cover corner seal member adapted to be secured to a joist at a corner of said unit, when assembled, and adapted by connection means to be connected to an edge of said first member.

12. Members as defined in claim 1, wherein there is rear cover plate means of substantially 'L'-shape in cross-sectional configuration and adapted to extend the length of said unit when assembled.

13. Members as defined in claim 1, further including bottom cover plate means adapted to extend the length of the unit when assembled and said bottom cover plate means including resilient lips at opposite edges, one of which resilient lips being adapted to clip over said first hinge means of said first member, whereby said bottom cover plate means is removably secured to said unit.

14. Members as defined in claim 1, wherein there is a water outlet member means, said water outlet member means having a similar cross-sectional configuration to that of said first member, and wherein said water outlet-member means has securing means adapted to receive and secure two adjacent ones of said first members adapted for connection to a drain pipe of a building.

15. Members as defined in claim 14, wherein said securing means comprises a channel at two opposite edges of said water outlet member means, each channel being of sufficient width to receive one first member, said channel including seal means which extends the length of said channel and is adapted sealingly to bear on said first member.

16. Members as defined in claim 1, wherein there is connecting unit means adapted for connecting together adjacent ones of said first members, said connecting unit means comprising a unit of similar cross-sectional configuration to that of said first members and including securing means for receiving and securing two adjacent ones of said first members, one on each side of said connecting unit means.

17. Members as defined in claim 16, wherein said securing means comprises a channel at two opposite edges of said connecting unit means, each channel being of sufficient width to receive one first member, said channel including seal means which extends the length of said channel and is adapted sealingly to bear on said first member.

18. Members as defined in claim 1 wherein there is barge board member means of substantially J-shape in cross-sectional configuration, said barge board member also comprises a channel section member adapted to be supported by the roof member of a building, one side of said channel section member extending beyond a web of said channel section member, said one side forming a nose remote from limbs of said channel section member.

19. Members for a fascia-soffit-gutter unit for the dispersal of rainwater from a roof of a building, comprising a preformed first member including hinge means and a preformed second member including hinge means complementary to the said first mentioned hinge means, whereby when the two hinge means are connected a hinge is formed so that said first member and said second member are connected for relative movement with respect to one another, and wherein there is barge board member means of substantially J-shape in cross-sectional configuration, said barge board member means also comprises a channel section member adapted to be supported by the roof member of a building, one side of said channel section member extending beyond a web of said channel section member, said one side forming a nose remote from limbs of said channel section member.

20. Members as defined in claim 19, further including a barge board apex member, said barge board apex member having two limbs mutually inclined in the same plane whereby the barge board apex member defines a V-shape, each of said two limbs including means for receiving and securing one end of said barge board member means when in position at the apex of a building.

21. Members of a combined fascia-soffit-gutter unit for the dispersal of rainwater from a roof of a building, comprising a preformed first member including a gutter portion and first hinge means, and a preformed second member including a soffit portion and second hinge means complementary to said first hinge means, whereby when the first and second hinge means are connected a hinge is formed so that said first member and said second member are connected for relative angular movement with respect to one another and comprise said combined fascia-soffit-gutter unit, said first member also including a fascia portion integrally associated therewith, said fascia portion having an upper edge thereof integrally interconnected to said gutter portion, and said first hinge means being formed adjacent the lower edge of said fascia portion.

* * * * *